US008822114B2

(12) United States Patent
Yamamoto

(10) Patent No.: US 8,822,114 B2
(45) Date of Patent: Sep. 2, 2014

(54) ELECTROPHOTOGRAPHIC PHOTORECEPTOR, IMAGE FORMING APPARATUS, AND PROCESS CARTRIDGE

(71) Applicant: Fuji Xerox Co., Ltd., Tokyo (JP)

(72) Inventor: Shinya Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 25 days.

(21) Appl. No.: 13/624,512

(22) Filed: Sep. 21, 2012

(65) Prior Publication Data

US 2013/0252151 A1 Sep. 26, 2013

(30) Foreign Application Priority Data

Mar. 26, 2012 (JP) ..... 2012-070219

(51) Int. Cl.
*G03G 5/00* (2006.01)

(52) U.S. Cl.
USPC ..... 430/66; 399/159

(58) Field of Classification Search
USPC ..... 430/66; 399/159
See application file for complete search history.

(56) References Cited

U.S. PATENT DOCUMENTS

| | | | | |
|---|---|---|---|---|
| 4,792,507 | A | 12/1988 | Yoshihara et al. | |
| 8,450,036 | B2 * | 5/2013 | Yamamoto | 430/66 |
| 2002/0119382 | A1 | 8/2002 | Nakata et al. | |
| 2003/0104295 | A1 | 6/2003 | Niimi | |

FOREIGN PATENT DOCUMENTS

| | | |
|---|---|---|
| JP | A-56-051749 | 5/1981 |
| JP | A-59-223442 | 12/1984 |
| JP | A-63-221355 | 9/1988 |
| JP | A-01-172970 | 7/1989 |
| JP | B2-02-007057 | 2/1990 |
| JP | A-04-012365 | 1/1992 |
| JP | A-04-189873 | 7/1992 |
| JP | A-04-324451 | 11/1992 |
| JP | A-04-345167 | 12/1992 |
| JP | A-05-043823 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-176293 | 7/1996 |
| JP | A-08-208820 | 8/1996 |
| JP | A-08-278645 | 10/1996 |
| JP | B2-2675035 | 11/1997 |
| JP | A-2002-082469 | 3/2002 |
| JP | A-2002-351115 | 12/2002 |
| JP | A-2003-186234 | 7/2003 |
| JP | B2-3773868 | 5/2006 |
| JP | B2-3831672 | 10/2006 |
| JP | A-2009-145480 | 7/2009 |

* cited by examiner

*Primary Examiner* — Mark A Chapman
(74) *Attorney, Agent, or Firm* — Oliff PLC

(57) ABSTRACT

An electrophotographic photoreceptor includes a substrate; a photosensitive layer that is provided on the substrate; and a surface layer that is provided on the photosensitive layer, contains fluororesin particles, is a single layer having a thickness of 3 μm or greater, and has a cross-section, taken along a thickness direction thereof, which satisfies specific expressions.

16 Claims, 5 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2012-070219 filed Mar. 26, 2012.

BACKGROUND

Technical Field

The present invention relates to an electrophotographic photoreceptor, an image forming apparatus, and a process cartridge.

SUMMARY

According to an aspect of the invention, there is provided an electrophotographic photoreceptor including a substrate; a photosensitive layer that is provided on the substrate; and a surface layer that is provided on the photosensitive layer, contains fluororesin particles, is a single layer having a thickness of 3 μm or greater, and has a cross-section, taken along a thickness direction thereof, which satisfies Expressions (1), (2), and (3) below:

$$0 \leq A_1 \leq 0.2 \times A_4 \quad \text{Expression (1)}$$

$$0.2 \times A_4 < A_2 \leq 0.6 \times A_4 \quad \text{Expression (2)}$$

$$0.6 \times A_4 < A_3 \quad \text{Expression (3)}$$

wherein, $A_1$ represents the ratio (%) of the area of the fluororesin particles to the total area of a first region in cross-section, in which the first region is located in a distance range of greater than or equal to 0.2 μm and less than 0.5 μm from the outermost surface of the surface layer to the substrate side;

$A_2$ represents the ratio (%) of the area of the fluororesin particles to the total area of a second region in cross-section, in which the second region is located in a distance range of greater than or equal to 0.5 μm and less than 1.5 μm from the outermost surface of the surface layer to the substrate side;

$A_3$ represents the ratio (%) of the area of the fluororesin particles to the total area of a third region in cross-section, in which the third region is located in a distance range of 1.5 μm to (the thickness of the surface layer-0.5 μm) from the outermost surface of the surface layer to the substrate side; and $A_4$ represents the ratio (%) of the area of the fluororesin particles to the total area of the cross-section.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described in detail.

Electrophotographic Photoreceptor

An electrophotographic photoreceptor (hereinafter, sometimes simply referred to as a "photoreceptor") according to an exemplary embodiment includes a substrate, a photosensitive layer which is provided on the substrate, and a surface layer which is provided above and in contact with the photosensitive layer.

The surface layer includes fluororesin particles, is a single layer having a thickness of 3 μm or greater, and has a cross-section, taken along a thickness direction thereof, which satisfies Expressions (1), (2), and (3) below.

In this case, it is preferable that the surface layer of the photoreceptor according to the exemplary embodiment satisfy Expressions (4), (5), and (6) below.

$$0 \leq A_1 \leq 0.2 \times A_4 \quad \text{Expression (1)}$$

$$0.2 \times A_4 < A_2 \leq 0.6 \times A_4 \quad \text{Expression (2)}$$

$$0.6 \times A_4 < A_3 \quad \text{Expression (3)}$$

$$0 \leq A_1 \leq 0.1 \times A_4 \quad \text{Expression (4)}$$

$$0.3 \times A_4 < A_2 \leq 0.5 \times A_4 \quad \text{Expression (5)}$$

$$0.9 \times A_4 < A_3 \quad \text{Expression (6)}$$

In Expressions (1) to (6) above, $A_1$ represents the ratio (%) of the area of the fluororesin particles to the total area of a first region in cross-section, in which the first region is located in a distance range of greater than or equal to 0.2 μm and less than 0.5 μm from the outermost surface of the surface layer to the substrate side;

$A_2$ represents the ratio (%) of the area of the fluororesin particles to the total area of a second region in cross-section, in which the second region is located in a distance range of greater than or equal to 0.5 μm and less than 1.5 μm from the outermost surface of the surface layer to the substrate side;

$A_3$ represents the ratio (%) of the area of the fluororesin particles to the total area of a third region in cross-section, in which the third region is located in a distance range of 1.5 μm to (the thickness of the surface layer-0.5 μm) from the outermost surface of the surface layer to the substrate side; and $A_4$ represents the ratio (%) of the area of the fluororesin particles to the total area of the cross-section.

Figure 6:
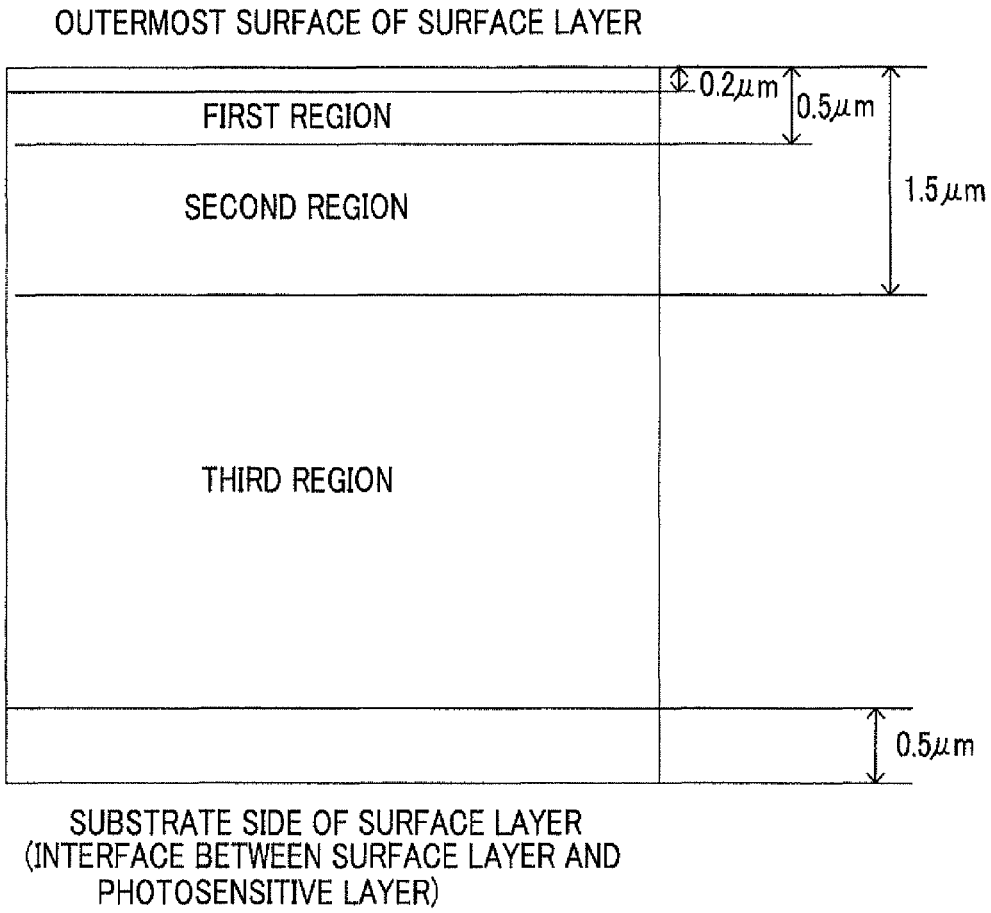
FIG. 6 is a diagram schematically illustrating first to third regions of a surface layer of an electrophotographic photoreceptor according to an exemplary embodiment.

When the outermost surface of the surface layer is used as an origin (reference point), the first to third regions are layers which are located in the above-described distance ranges along a thickness direction of the surface layer from the origin to the substrate side (refer to FIG. 6).

In particular, the third region is a layer which is interposed between a portion having a distance of 1.5 μm from the outermost surface of the surface layer to the substrate side and a portion having a distance of 0.5 μm from the interface between the surface layer and the photosensitive layer to the outermost surface side of the surface layer in cross-section (refer to FIG. 6).

Specifically, values of $A_1$, $A_2$, $A_3$, and $A_4$ are obtained as follows for example, a cross-section in the thickness direction of the surface layer (hereinafter, sometimes, simply referred to as "the cross-section of the surface layer"), which is obtained by cutting the surface layer of the photoreceptor with a knife or the like along a thickness direction thereof and treating the exposed cut surfaces with a microtome, is observed using a scanning electron microscope (SEM) to obtain a cross-sectional SEM image of the surface layer. As the scanning electron microscope, for example, JSM-6700F or JED-2300F (manufactured by JEOL Ltd.) is used.

In the obtained cross-sectional SEM image, the area of the cross-section where fluororesin particles are cut and exposed (that is, the area of the fluororesin particles) is calculated and the ratio (%) of the area of the fluororesin particles to the total area of the cross-section of the surface layer is calculated, as a value of $A_4$.

Similarly, in cross-section of the surface layer, in the region (first region) located in the distance range (distance along the thickness direction; hereinafter the same shall be applied) of greater than or equal to 0.2 μm and less than 0.5 μm from the outermost surface of the surface layer to the substrate side, the ratio (%) of the area of the fluororesin particles to the total area of the cross-section of the surface layer is calculated as a value of $A_1$.

Similarly, in cross-section of the surface layer, in the region (second region) located in the distance range of greater than or equal to 0.5 μm and less than 1.5 μm from the outermost surface of the surface layer to the substrate side, the ratio (%) of the area of the fluororesin particles to the total area of the cross-section of the surface layer is calculated as a value of $A_2$.

Similarly, in cross-section of the surface layer, in the region (third region) located in the distance range of 1.5 μm to (the thickness of the surface layer-0.5 μm) from the outermost surface of the surface layer to the substrate side, the ratio (%) of the area of the fluororesin particles to the total area of the cross-section of the surface layer is calculated as a value of $A_3$.

In the photoreceptor according to the exemplary embodiment, with the above-described configuration, removability for toner remaining on the surface of the electrophotographic photoreceptor is maintained for a longer period of time than that of a case where a cross-section in a thickness direction of a surface layer does not satisfy the above Expressions.

The reason is not clear but considered to be as follows.

First, it is considered that the photoreceptor in which the surface layer includes the fluororesin particles as in the case of the exemplary embodiment has a lower surface energy of the surface of the photoreceptor and a superior release property for toner remaining on the surface of the photoreceptor (that is, superior removability of the remaining toner), as compared to a photoreceptor in which a surface layer does not include fluororesin particles. Furthermore, it is considered that there is an effect in that the coefficient of friction is reduced due to the lower surface energy, the wear rate of the photoreceptor is reduced, and thus a reduction in the lifetime of the photoreceptor due to the abrasion is suppressed.

Incidentally, since the surface layer of a photoreceptor is worn away and becomes thin along with its use, the surface state is changed from that of the initial stage. In general, it is considered that this change is an increase in surface roughness. For example, it is considered that an unused photoreceptor generally has an extremely smooth surface, and furthermore, when a surface layer thereof contains a smoothing agent such as silicone oil, bleeding to the outermost surface of the surface layer may occur; and as a result, the surface state may be largely different from that of a photoreceptor with the surface worn away to some degree.

It is considered that, when toner is cleaned using a cleaning blade or the like, blade contact conditions suitable for toner removal vary greatly depending on the surface state of a photoreceptor; and the change of the surface state of a photoreceptor is significantly disadvantageous for maintaining the same cleaning property from the initial stage to the end of lifetime, that is, for maintainability of the cleaning property.

It is considered that, when fluororesin particles are uniformly dispersed in the outermost surface of a surface layer, the wear rate is low from the initial stage and thus the initial surface having different states is maintained for a long period of time; whereas, when there are no fluororesin particles or a small amount of fluororesin particles in the outermost layer region of a surface layer in the initial stage, the region is rapidly worn away and the surface state such as surface roughness is likely to be rapidly stabilized.

Therefore, the content (%) of fluororesin particles in the region (first region) located in the distance range of greater than or equal to 0.2 μm and less than 0.5 μm from the outermost surface of the surface layer to the substrate side, is set to 0.2 or less time the content of fluororesin particles in the entire surface layer. As a result, it is considered that the above-described effect is exhibited.

In this case, the content of fluororesin particles in a region located in a distance range of 0 μm to 0.2 μm from the outermost surface of the surface layer to the substrate side, may be greater than that in the first region. However, even if this region contains fluororesin particles, the region is worn away by the initial operation of an image forming apparatus provided with an unused photoreceptor or worn away in the very initial stages of image forming processes; and thus does not have an effect on the change of the surface state of the surface layer, that is, does not have an effect on toner removal.

On the other hand, the content (%) of fluororesin particles in the region (second region) located in the distance range of greater than or equal to 0.5 μm and less than 1.5 μm from the outermost surface of the surface layer to the substrate side, is set to greater than 0.2 time and less than or equal to 0.6 time the content of fluororesin particles in the entire surface layer. As a result, it is considered that, when the abrasion of the surface layer advances to some degree, an effect of a toner release property which is improved by the fluororesin particles included in the region starts to be exhibited. When the content is set to be less than or equal to 0.2 time, it is considered that the effect is slowly exhibited and cleaning failure is likely to occur. In addition, when the content is set to be greater than 0.6 time, it is considered that the wear rate is excessively reduced before the surface state of a surface layer is completely stabilized by the abrasion; and thus cleaning failure is also likely to occur.

In addition, the content (%) of fluororesin particles in the region (third region) located in the distance range of 1.5 μm to (the thickness of the surface layer-0.5 μm) from the outermost surface of the surface layer to the substrate side, is set to greater than 0.6 time the content of fluororesin particles in the entire surface layer. As a result, it is considered that, after the surface state of the surface layer is stabilized by the abrasion, the effect of the fluororesin particles included in the region is sufficiently exhibited.

As described above, in the photoreceptor according to the exemplary embodiment, the initial surface in which the surface states of a surface layer are largely different contains less fluororesin particles and thus is rapidly worn away; and as abrasion advances and the surface state is stabilized, the amount of fluororesin particles increases. As a result, it is considered that the effect of the addition of fluororesin particles is exhibited and the maintainability of the cleaning property is secured from the initial stage to the end of lifetime.

When the thickness of a remaining surface layer is less than 0.5 μm, it is considered that, irrespective of the characteristics of the surface layer (for example, even when the strength of the surface layer is high), the surface layer is easily peeled off and use of the photoreceptor is difficult. Therefore, it is currently not being assumed that a photoreceptor is used until the thickness of a remaining surface layer thereof reaches 0.5 μm.

Accordingly, in a region located in a distance range of greater than (the thickness of the surface layer-0.5 μm) from the outermost surface of the surface layer to the substrate side (that is, region located in a distance range of less than 0.5 μm from the interface between the surface layer and the photosensitive layer to the outermost surface of the surface layer), it is not necessary to consider the content of fluororesin particles.

In addition, in the photoreceptor according to the exemplary embodiment, the surface laser is a single layer as described above. Therefore, it is considered that peeling which may occur, for example, when the surface layer is configured by two or more layers containing fluororesin particles, that is, peeling which may occur along with the reduction in surface energy, caused by fluororesin particles, in the respective interfaces between the layers of the surface layer (that is, when the surface layer is configured by two layers, the interface between one layer and the other layer), does not occur.

In the photoreceptor according to the exemplary embodiment, as described above, removability for toner remaining on the surface of the photoreceptor is maintained. Therefore, by applying the photoreceptor according to the exemplary embodiment to a process cartridge or an image forming apparatus, it is considered that image defects (for example, streaks due to unevenness of image density) caused by deterioration of the removability of the remaining toner are suppressed and a high-quality image is formed over a long period of time.

According to the exemplary embodiment, for example, the surface layer of which the cross-section satisfies Expressions (1), (2), and (3) may include a cross-linked component (reaction product) of a mixture containing a cross-linking compound having an alkoxy group (hereinafter, sometimes referred to as "the alkoxy compound") and a cross-linking compound having a hydroxyl group (hereinafter, sometimes referred to as "the hydroxy compound").

In addition, a method of preparing the photoreceptor in which the cross-section of the surface layer satisfies Expressions (1), (2), and (3) may include, for example, a process of preparing a laminate by laminating a photosensitive layer on a substrate; a process of preparing a surface-layer-forming coating solution which contains fluororesin particles, the alkoxy compound, and the hydroxy compound; a process of coating the outer peripheral surface of the laminate with the surface-layer-forming coating solution; and a process of forming a surface layer by curing the surface-layer-forming coating solution with which the outer peripheral surface of the laminate is coated.

In this case, examples of the alkoxy compound include, for example, compounds having two or more alkoxy groups and examples of the hydroxy compound may include, for example, two or more hydroxyl groups.

As described above, by using the alkoxy compound and the hydroxy compound, the cross-section of the surface layer satisfies Expressions (1), (2), and (3). As a result, a photoreceptor, in which removability for toner remaining on the surface is maintained, may be obtained.

The reason is not clear but considered to be as follows.

It is considered that a reaction (cross-linking reaction) of the hydroxy compound is accompanied by dehydration condensation and advances along with the generation of water and volume shrinkage. In addition, it is considered that the reaction (cross-linking reaction) of the hydroxy compound advances from the outside (outermost surface side) toward the inside (photosensitive layer side) of the surface layer.

That is, when the surface layer is formed, the viscosity of a coating layer increases from the outside (outermost surface side). Therefore, it is considered that a force to move fluororesin particles as a dispersed material thereof to the inside having a lower viscosity (photosensitive layer side).

However, it is considered that the reaction of the hydroxy compound is rapidly performed, and when the hydroxy compound is used alone, the viscosity of the entire coating solution increases before the fluororesin particles are moved to the inside (photosensitive layer side) of the coating layer and the cross-linking reaction is finished. That is, practically, it is considered that, before the fluororesin particles are moved, the surface layer is formed and fixed.

On the other hand, it is considered that, when the alkoxy compound having a lower reaction rate than that of the hydroxy compound is used in combination with the hydroxy compound, the gradient of rise in the viscosity of the coating solution is suppressed. Accordingly, it is considered that, after the fluororesin particles are moved to the inside (photosensitive layer side) of the coating layer, the cross-linking reaction is finished. That is, practically, it is considered that the surface layer is formed and fixed in a state where the fluororesin particles are unevenly dispersed to the inside (photosensitive layer side) of the surface layer.

Accordingly, it is considered that, by using the alkoxy compound and the hydroxy compound, the cross-section of the surface layer satisfies Expressions (1), (2), and (3); and as a result, a photoreceptor, in which removability for toner remaining on the surface is maintained, is obtained.

Layer Configuration of Photoreceptor

Hereinafter, a layer configuration of the photoreceptor will be described.

The photoreceptor according to the exemplary embodiment is not particularly limited as long as it includes at least the substrate, the photosensitive layer and the surface layer; and the surface layer is provided in contact with the photosensitive layer, as described above. For example, the photosensitive layer may be configured by plural layers and another layer such as an undercoat layer may be further provided at a position interposed between the substrate and the photosensitive layer.

Hereinafter, a configuration of the photoreceptor according to the exemplary embodiment will be described with reference to FIGS. 1 to 3, but the exemplary embodiment is not limited by FIGS. 1 to 3.

Figure 1:
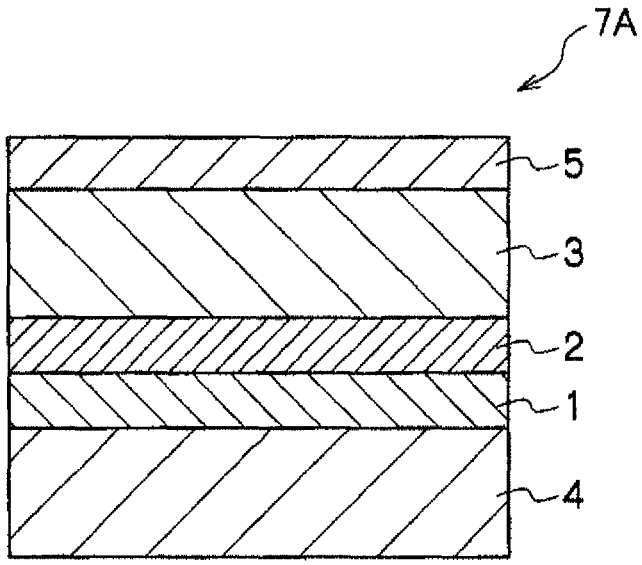
FIG. 1 is a cross-sectional view schematically illustrating a part of an electrophotographic photoreceptor according to a first aspect of an exemplary embodiment.

FIG. 1 is a cross-sectional view schematically illustrating a preferred example of the electrophotographic photoreceptor according to the exemplary embodiment. FIGS. 2 and 3 are cross-sectional views schematically illustrating other examples of the electrophotographic photoreceptor according to the exemplary embodiment.

An electrophotographic photoreceptor 7A illustrated in FIG. 1 is a so-called functional separation type photoreceptor (or layered photoreceptor) in which an undercoat layer 1 is provided on a substrate 4; a photosensitive layer in which a charge generation layer 2 and a charge transport layer 3 are formed in this order is provided thereon; and a protective layer 5 is provided thereon (first aspect). In the electrophotographic photoreceptor 7A illustrated in FIG. 1, the photosensitive layer composed of the charge generation layer 2 and the charge transport layer 3 correspond to the photosensitive layer and the protective layer 5 corresponds to the surface layer.

Figure 2:
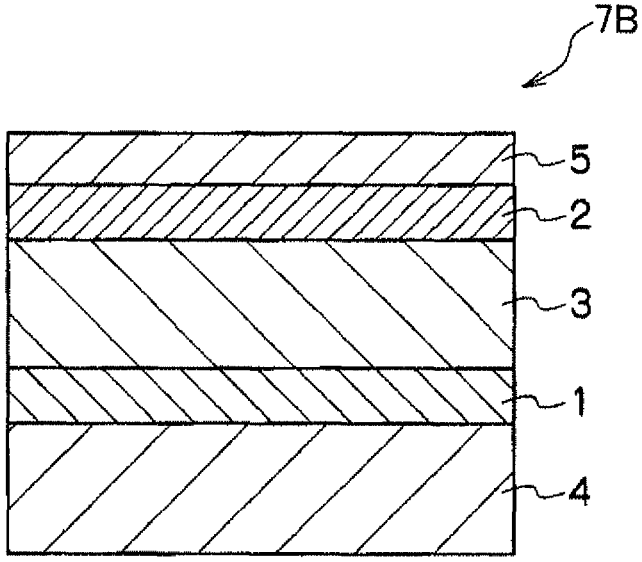
FIG. 2 is a cross-sectional view schematically illustrating a part of an electrophotographic photoreceptor according to a second aspect of the exemplary embodiment.

Similarly to the electrophotographic photoreceptor 7A illustrated in FIG. 1, an electrophotographic photoreceptor 7B illustrated in FIG. 2 is a functional separation type photoreceptor in which the charge generation layer 2 and the charge transport layer 3 are functionally separated. In this configuration, the undercoat layer 1 is provided on the substrate 4; a photosensitive layer in which the charge transport layer 3 and the charge generation layer 2 are formed in this order is provided thereon; and the protective layer 5 is provided thereon (second aspect). In the electrophotographic photoreceptor 7B illustrated in FIG. 2, the photosensitive layer composed of the charge transport layer 3 and the charge generation layer 2 correspond to the photosensitive layer and the protective layer 5 corresponds to the surface layer.

Figure 3:
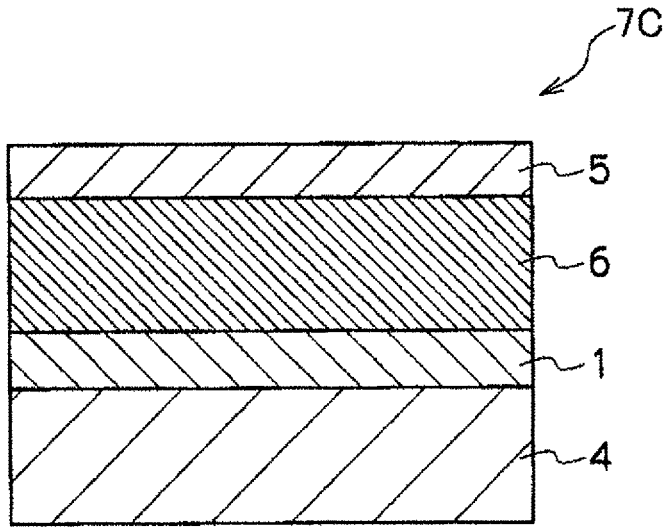
FIG. 3 is a cross-sectional view schematically illustrating a part of an electrophotographic photoreceptor according to a third aspect of the exemplary embodiment.

An electrophotographic photoreceptor 7C illustrated in FIG. 3 is a functional integration type photoreceptor which includes a charge generation material and a charge transport material in the same layer (charge generation and transport layer 6) and has a structure in which the undercoat layer 1 is provided on the substrate 4; and the charge generation and transport layer 6 and the protective layer 5 are formed in this order thereon. The electrophotographic photoreceptor 70 includes a single-layered photosensitive layer configured by the charge generation and transport layer 6 (third aspect). In the electrophotographic photoreceptor 7C illustrated in FIG. 3, the charge generation and transport layer 6 corresponds to the photosensitive layer and the protective layer 5 corresponds to the surface layer.

In the electrophotographic photoreceptors illustrated in FIGS. 1 to 3, the undercoat layer 1 may be or may not be provided.

Hereinafter, the respective components will be described using the electrophotographic photoreceptor 7A illustrated in FIG. 1 as a representative example.

First Aspect

As described above, the electrophotographic photoreceptor 7A illustrated in FIG. 1 has a layer configuration in which the undercoat layer 1, the charge generation layer 2, the charge transport layer 3, and the protective layer 5 are laminated in this order on the substrate 4.

Protective Layer 5

The protective layer 5 as the surface layer is not particularly limited as long as it includes fluororesin particles and the cross-section satisfies Expressions (1), (2), and (3) as described above. For example, the protective layer may include a cross-linked component of a mixture containing the alkoxy compound and the hydroxy compound.

The thickness of the protective layer 5 is greater than or equal to 3 μm as described above, and may be from 3 μm to 15 μm or from 6 μm to 10 μm.

The content of fluororesin particles in the entire protective layer 5 is, for example, from 1% by weight to 30% by weight, and may be from 3% by weight to 20% by weight or from 5% by weight to 12% by weight.

In addition, the protective layer 5 may further contain a copolymer having an alkyl fluoride group. The amount of the copolymer having an alkyl fluoride group added is, for example, from 1 part by weight to 20 parts by weight with respect to 100 parts by weight of fluororesin particles.

In particular, the amount of the copolymer having an alkyl fluoride group added, which is preferable from the viewpoint of making values of $A_1$, $A_2$, and $A_3$ satisfy Expressions (1), (2), and (3), changes depending on the kind and the particle size of fluororesin particles, the kind of the copolymer having an alkyl fluoride group, and the like. For example, when PTFE particles with an average primary particle size of 0.2 μm are used as the fluororesin particles and GF400 (manufactured by TOAGOSEI CO., LTD.) is used as the copolymer having an alkyl fluoride group, the amount of the copolymer having an alkyl fluoride group added is from 1 part by weight to 15 parts by weight, and may be from 2.5 parts by weight to 10 parts by weight or from 4 parts by weight to 7 parts by weight.

When the protective layer 5 contains a cross-linked component of a mixture containing the alkoxy compound and the hydroxy compound, the content of components derived from the alkoxy compound in the cross-linked component is, for example, from 0.1 time to 3.0 times the content of components derived from the hydroxy compound, and may be from 0.2 time to 1.5 times or from 0.3 time to 1.0 time.

Specifically, as the protective layer 5, for example, a cured layer including a cross-linked component (hereinafter, sometimes referred to as "the specific cross-linked component") of at least one kind selected from a compound having a guanamine structure (hereinafter, sometimes referred to as the guanamine compound) and a compound having a melamine structure (hereinafter, sometimes referred to as "the melamine compound); and a charge transport material as the alkoxy compound and a charge transport material as the hydroxy compound, may be used. As the charge transport materials which form the specific cross-linked component, the alkoxy compound and the hydroxy compound may be used in combination with another charge transport material.

Hereinafter, the charge transport material as the alkoxy compound, the charge transport material as the hydroxy compound, and another charge transport material are sometimes collectively referred to as "the charge transport materials".

When the protective layer 5 includes the specific cross-linked component, the total content of the guanamine compound and the melamine compound with respect to the specific cross-linked component (that is, the content with respect to the total solid content excluding the fluororesin particles and the copolymer having an alkyl fluoride group) is, for example, from 0.1% by weight to 20% by weight, and may be from 0.1% by weight to 5% by weight or from 1% by weight to 3% by weight.

In addition, the content of components derived from the alkoxy compound with respect to the total weight of the specific cross-linked component (that is, the content with respect to the total solid content excluding the fluororesin particles and the copolymer having an alkyl fluoride group) is, for example, from 10% by weight to 70% by weight, and may be from 20% by weight to 50% by weight or from 25% by weight to 45% by weight.

On the other hand, the content of components derived from the hydroxy compound with respect to the total weight of the specific cross-linked component (that is, the content with respect to the total solid content excluding the fluororesin particles and the copolymer having an alkyl fluoride group) is, for example, from 30% by weight to 90% by weight, and may be from 40% by weight to 75% by weight or from 45% by weight to 60% by weight.

Furthermore, the content of components derived from the charge transport materials (the alkoxy compound, the hydroxy compound, and another charge transport material) with respect to the total weight of the specific cross-linked component (that is, the content with respect to the total solid content of the protective layer 5 from which the fluororesin particles and the copolymer having an alkyl fluoride group are excluded) is, for example, greater than or equal to 80% by weight, and may be greater than or equal to 90% by weight or greater than or equal to 95% by weight.

Hereinafter, as an example of the protective layer 5, a cured layer containing the specific cross-linked component will be described in detail, but the protective layer 5 is not limited thereto.

Fluororesin Particles

The fluororesin particles are not particularly limited as long as they are particles configured to contain a resin containing fluorine atoms, and examples thereof include particles of polytetrafluoroethylene (PTFE), polychlorotrifluoroethylene, polyhexafluoropropylene, polyvinyl fluoride, polyvinylidene fluoride, and polydichlorodifluoroethylene. As the fluororesin particles, these examples may be used alone or in combination of two or more kinds.

The average primary particle size of the fluororesin particles is, for example, from 0.05 μm to 1 μm, and may be from 0.1 μm to 0.5 μm.

In this case, the average primary particle size of the fluororesin particles represents a value which is obtained by measuring a measurement solution diluted with the same solvent as a dispersion in which the fluororesin particles are dispersed, at a refractive index of 1.35 using a laser diffraction particle size distribution analyzer LA-920 (manufactured by HORIBA Ltd.).

Guanamine Compound

The guanamine compound is a compound having a guanamine structure, and examples thereof include acetoguanamine, benzoguanamine, formoguanamine, steroguanamine, spiroguanamine, and cyclohexylguanamine.

In particular, it is preferable that the guanamine compound is at least one kind selected from compounds represented by Formula (A) below and polymers thereof. In this case, the polymers represent oligomers obtained by polymerization of compounds represented by Formula (A) as a structural unit, and the polymerization degree thereof is, for example, from 2 to 200 (preferably from 2 to 100). As the compound represented by Formula (A), the above examples may be used alone or in combination of two or more kinds.

Formula (A)

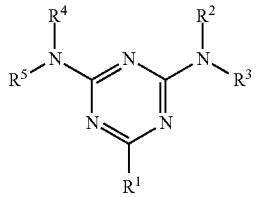

In Formula (A), $R^1$ represents a linear or branched alkyl group having from 1 to 10 carbon atoms, substituted or unsubstituted phenyl group having from 6 to carbon atoms, or a substituted or unsubstituted alicyclic hydrocarbon group having from 4 to 10 carbon atoms. $R^2$ to $R^5$ each independently represents hydrogen, —$CH_2$—OH or —$CH_2$—O—$R^6$. $R^6$ represents a linear or branched alkyl group having from 1 to 10 carbon atoms.

In Formula (A), the number of carbon atoms of the alkyl group represented by $R^1$ is preferably from 1 to 10, more preferably from 1 to 8, and still more preferably from 1 to 5. In addition, the alkyl group may be linear or branched.

In Formula (A), the number of carbon atoms of the phenyl group represented by $R^1$ is preferably from 6 to 10 and more preferably from 6 to 8. Examples of a substituent for the substituted phenyl group include a methyl group, an ethyl group, and a propyl group.

In Formula (A), the number of carbon atoms of the alicyclic hydrocarbon group represented by $R^1$ is preferably from 4 to 10 and more preferably from 5 to 8. Examples of a substituent for the substituted alicyclic hydrocarbon group include a methyl group, an ethyl group, and a propyl group.

In "—$CH_2$—O—$R^6$" represented by $R^2$ to $R^5$ of Formula (A), the number of carbon atoms of the alkyl group represented by $R^6$ is preferably from 1 to 10, more preferably from 1 to 8, and still more preferably from 1 to 6. In addition, the alkyl group may be linear or branched. Preferable examples thereof include a methyl group, an ethyl group, and a butyl group.

It is particularly preferable that the compound represented by Formula (A) is a compound in which $R^1$ represents a substituted or unsubstituted phenyl group having from 6 to 10 carbon atoms; and $R^2$ to $R^5$ each independently represents —$CH_2$—O—$R^6$. In addition, it is preferable that $R^6$ represent a methyl group or an n-butyl group.

The compound represented by Formula (A) is synthesized by using, for example, guanamine and formaldehyde according to a well-known method (for example, refer to the fourth series of Experimental Chemistry, vol. 28, p. 430).

Hereinafter, specific examples of the compound represented by Formula (A) are shown, but the compound represented by Formula (A) is not limited to these examples. In addition, the following specific examples represent monomers and may be polymers (oligomers) having the monomers as a structural unit.

(A)-1

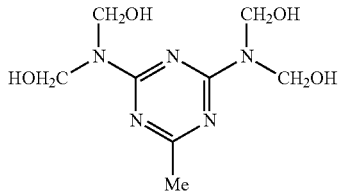

(A)-2

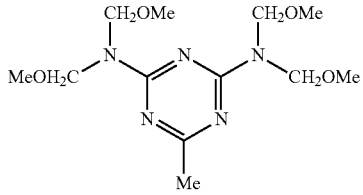

(A)-3

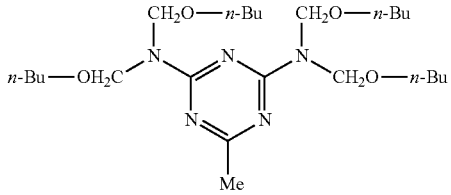

-continued
(A)-4
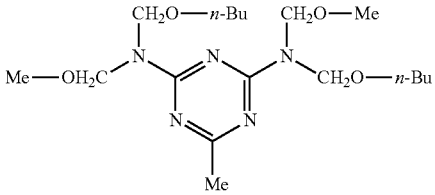
(A)-5
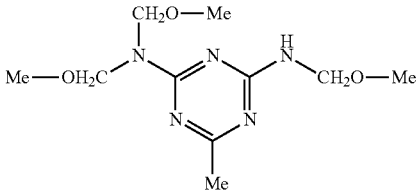
(A)-6
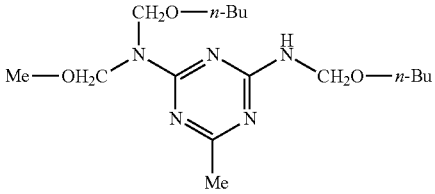
(A)-7
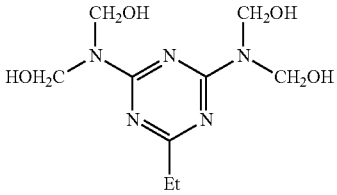
(A)-8
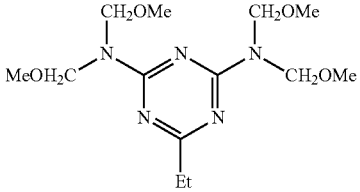
(A)-9
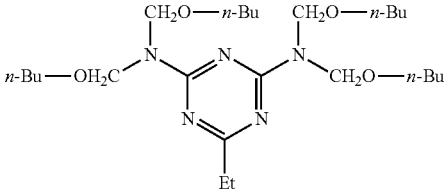
(A)-10
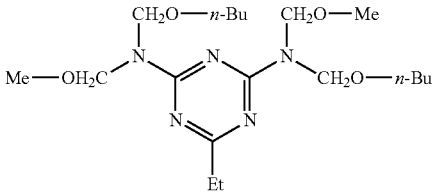
(A)-11
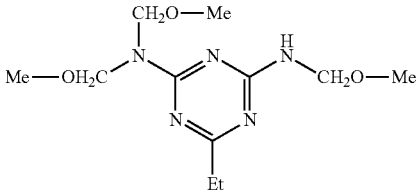
-continued
(A)-12
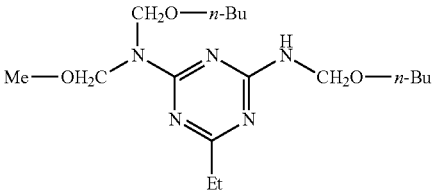
(A)-13
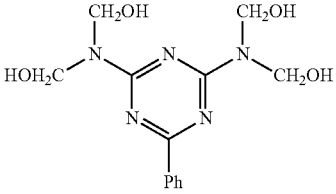
(A)-14
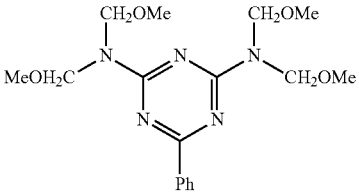
(A)-15
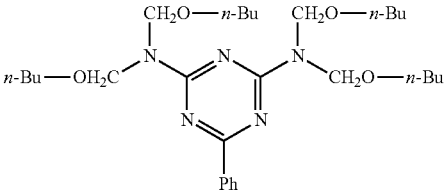
(A)-16
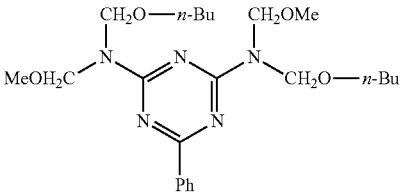
(A)-17
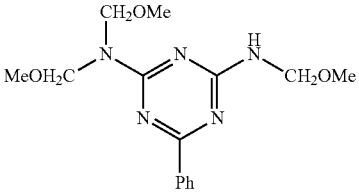
(A)-18
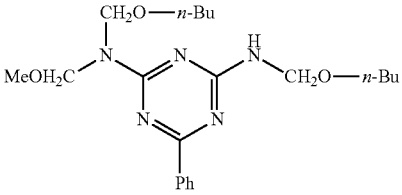

-continued
(A)-19
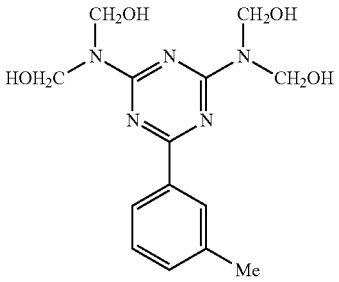
(A)-20
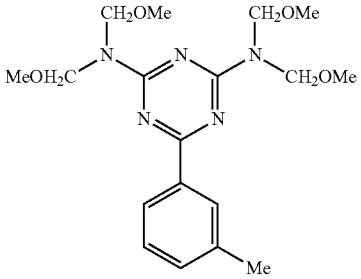
(A)-21
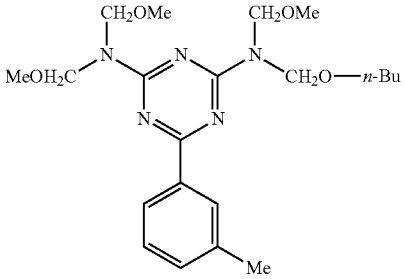
(A)-22
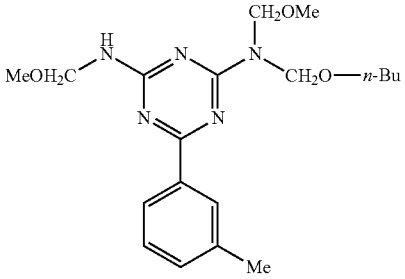
(A)-23
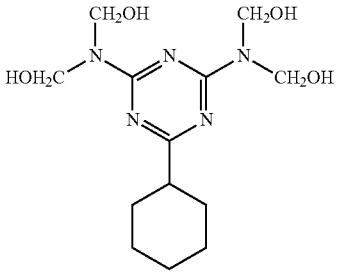
-continued
(A)-24
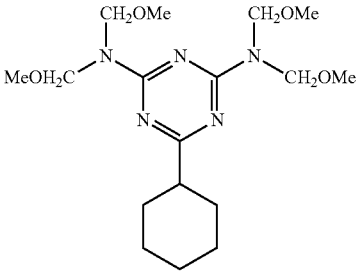
(A)-25
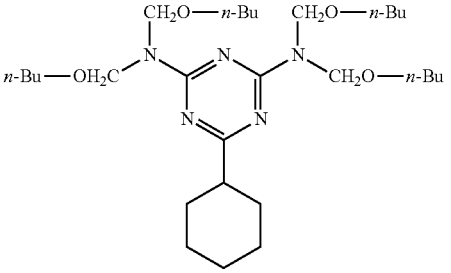
(A)-26
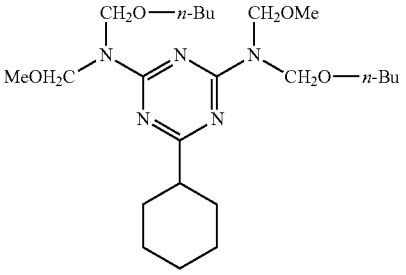
(A)-27
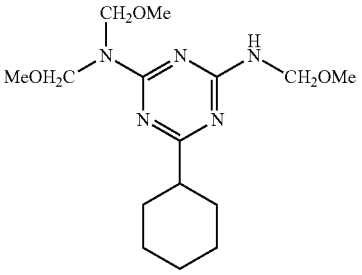
(A)-28
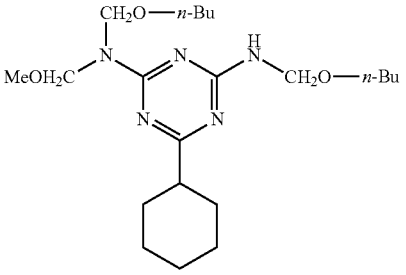

-continued
(A)-29
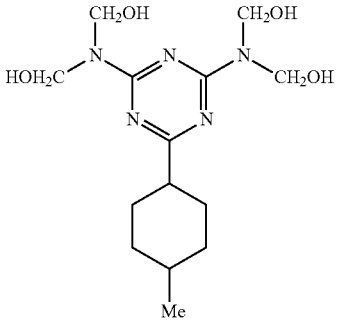
(A)-30
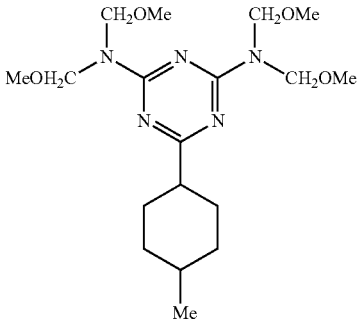
(A)-31
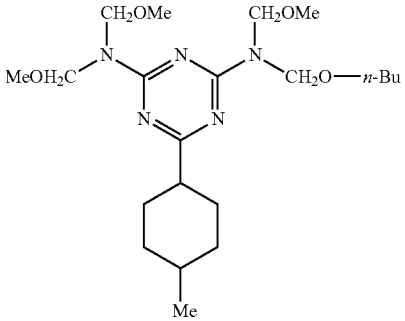
(A)-32
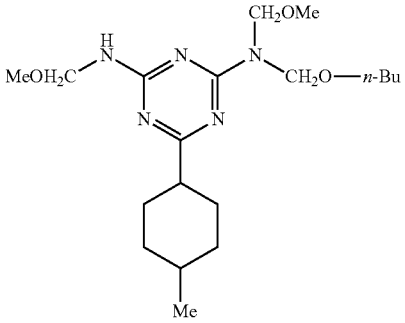
(A)-33
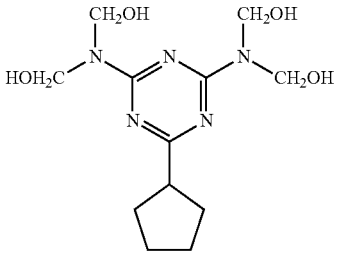
-continued
(A)-34
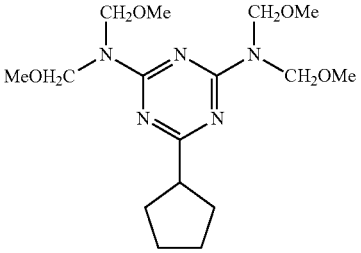
(A)-35
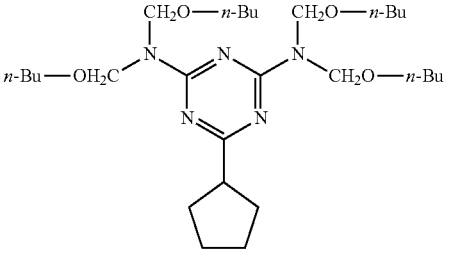
(A)-36
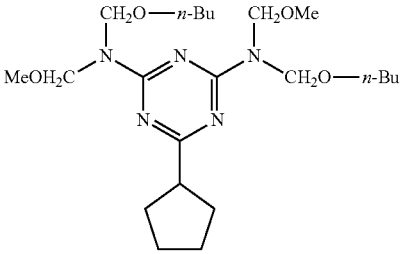
(A)-37
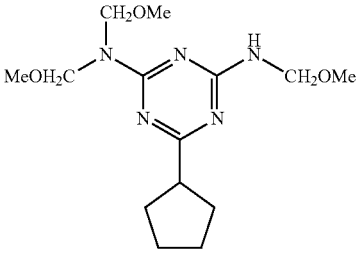
(A)-38
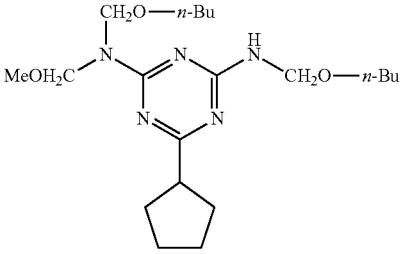
(A)-39
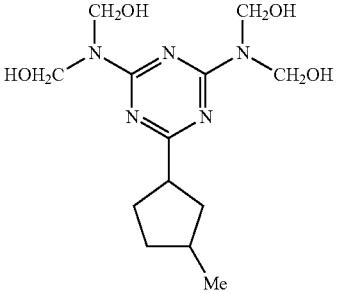

-continued (A)-40

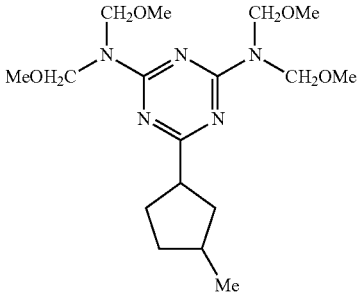

(A)-41

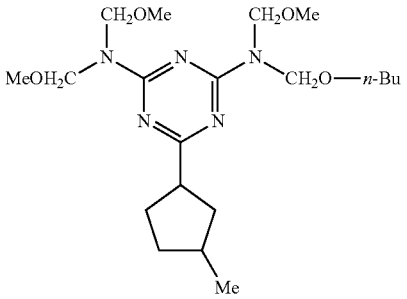

(A)-42

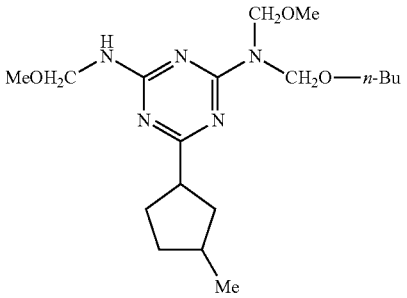

Examples of commercially available products of the compound represented by Formula (A) include SUPER BECKAMINE (R) L-148-55, SUPER BECKAMINE (R) 13-535, SUPER BECKAMINE (R) L-145-60, and SUPER BECKAMINE (R) TD-126 (all of which are manufactured by DIC Corporation); and NIKALAC BL-60 and NIKALAC BX-4000 (both of which are manufactured by NIPPON CARBIDE INDUSTRIES CO., INC.).

In addition, after being synthesized or purchasing a commercially available product, in order to exclude the effect of residual catalyst, the compound (including polymers) represented by Formula (A) may be dissolved in an appropriate solvent such as toluene, xylene, and ethyl acetate and washed with distilled water, ion exchange water, or the like; or may be treated with ion exchange resin.

Melamine Compound

It is preferable that the melamine compound is selected from compounds represented by Formula (B) below and polymers thereof. In this case, similarly to the case of Formula (A), the polymers represent oligomers obtained by polymerization of compounds represented by Formula (B) as a structural unit, and the polymerization degree thereof is, for example, from 2 to 200 (preferably from 2 to 100). As the compound represented by Formula (B) or the polymer thereof, the above examples may be used alone or in combination of two or more kinds. The compound represented by Formula (B) may be used in combination with the compound represented by Formula (A) or the polymer thereof.

Formula (B)

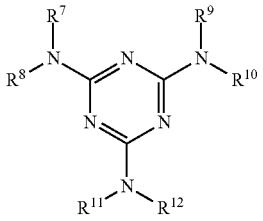

In Formula (B), $R^7$ to $R^{12}$ each independently represents a hydrogen atom, —$CH_2$—OH, —$CH_2$—O—$R^{13}$, and —O—$R^{13}$; and $R^{13}$ represents an alkyl group having from 1 to 5 carbon atoms which may be branched. Examples of the alkyl group include a methyl group, an ethyl group, and a butyl group.

The compound represented by Formula (B) is synthesized by using, for example, melamine and formaldehyde according to a well-known method (for example, synthesized in the same method as that of melamine resin described in the fourth series of Experimental Chemistry, vol. 28, p. 430).

Hereinafter, specific examples of the compound represented by Formula (B) are shown, but the compound represented by Formula (B) is not limited to these examples. In addition, the following specific examples represent monomers and may be polymers (oligomers) using the monomers as a structural unit.

(B)-1

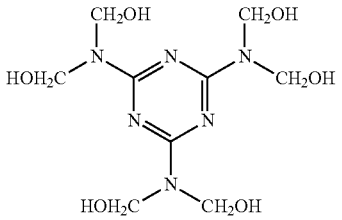

(B)-2

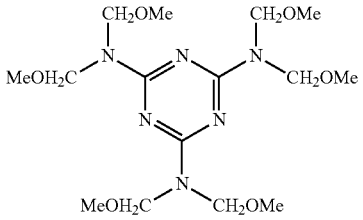

(B)-3

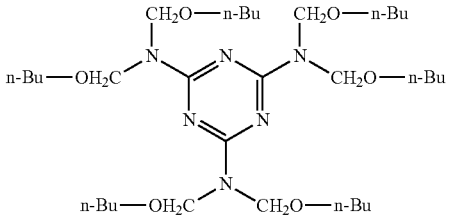

-continued (B)-4

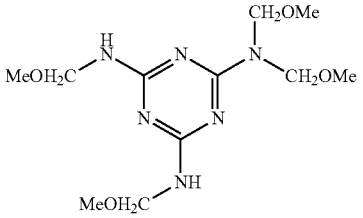

(B)-5

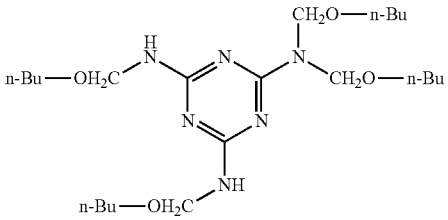

(B)-6

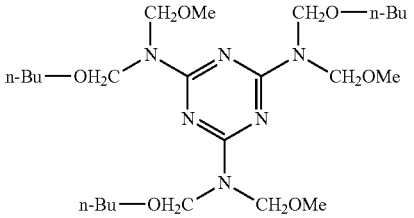

(B)-7

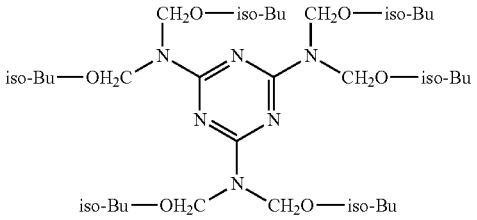

(B)-8

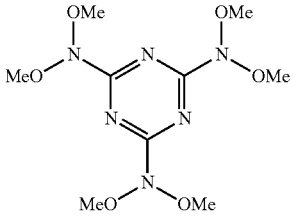

Examples of commercially available products of the compound represented by Formula (B) include SUPER MELAMINE No. 90 (manufactured by NOF CORPORATION), SUPER BECKAMINE (R) TD-139-60 (manufactured by DIC Corporation), U-VAN 2020 (manufactured by Mitsui Chemicals Inc.), SUMITEX RESIN M-3 (manufactured by Sumitomo Chemical Co., Ltd.), and NIKALAC MW-30 (manufactured by NIPPON CARBIDE INDUSTRIES CO., INC.).

In addition, after being synthesized or purchasing a commercially available product, in order to exclude the effect of residual catalyst, the compound (including polymers) represented by Formula (B) may be dissolved in an appropriate solvent such as toluene, xylene, and ethyl acetate and washed with distilled water, ion exchange water, or the like; or may be treated with ion exchange resin.

Charge Transport Material

Hereinafter, the charge transport material as the alkoxy compound, the charge transport material as the hydroxy compound, and another charge transport material (the charge transport materials) will be described.

As described above, as the charge transport materials, for example, an example of using both the alkoxy compound and the hydroxy compound may be used. In addition, for example, another charge transport material may include at least one substituent selected from —$NH_2$, —SH, and —COOH.

For example, the charge transport materials may include two or more of the above-described substituents (for example, regarding the alkoxy compound, an alkoxy group) or may include three or more of the above-described substituents.

Specific examples of the charge transport materials include compounds represented by Formula (I) below.

$$F—((—R^{14}—X)_{n1}(R^{15})_{n3}—Y)_{n2} \quad (I)$$

In Formula (I), F represents an organic group derived from a compound having a hole transport function;

$R^{14}$ and $R^{15}$ each independently represents a linear or branched alkylene group having from 1 to 5 carbon atoms; n1 represents 0 or 1; n2 represents an integer of 1 to 4; and n3 represents 0 or 1. X represents an oxygen atom, NH, or a sulfur atom; Y represents —OH, —$OCH_3$, —$NH_2$, —SH, or —COOH (that is, the above-described specific reactive functional group).

In the organic group derived from a compound having a hole transport function represented by F in Formula (I), arylamine derivatives are preferable as the compound having a hole transport function. Examples of the arylamine derivatives include triphenylamine derivatives and tetraphenylbenzidine derivatives.

It is preferable that the compound represented by Formula (I) is a compound represented by Formula (II) below.

(II)

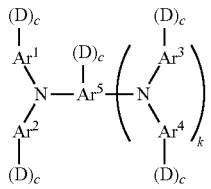

In Formula (II), $Ar^1$ to $Ar^4$ may be the same as or different from each other and each independently represents a substituted or unsubstituted aryl group; $Ar^5$ represents a substituted or unsubstituted aryl group or a substituted or unsubstituted arylene group; D represents —(—$R^{14}$—X)$_{n1}$($R^{15}$)$_{n3}$—Y; c each independently represents 0 or 1; k represents 0 or 1; and the sum total of D is 1 to 4. In addition, $R^{14}$ and $R^{15}$ each independently represents a linear or branched alkylene group having from 1 to 5 carbon atoms; n1 represents 0 or 1; n3 represents 0 or 1; X represents an oxygen atom, NH, or a sulfur atom; and Y represents —OH, —$OCH_3$,—$NH_2$, —SH, or —COOH.

In this case, examples of a substituent of the substituted aryl group other than -D include an alkyl group having from 1 to 4 carbon atoms; an alkoxy group having from 1 to 4 carbon atoms; and an aryl group having from 6 to 10 carbon atoms, in which the alkyl group, the alkoxy group, the aryl group may be substituted or unsubstituted.

In Formula (II), regarding "—(—$R^{14}$—X)$_{n1}$($R^{15}$)$_{n3}$—Y" represented by D, similarly to the case of Formula (I), $R^{14}$ and $R^{15}$ each independently represents a linear or branched alkylene group having from 1 to 5 carbon atoms. In addition, it is preferable that n1 represents 1. In addition, it is preferable that X represent an oxygen atom. In addition, it is preferable that Y represent a hydroxyl group.

The sum total of D in Formula (II) corresponds to n2 in Formula (I), and is preferably from 2 to 4 and more preferably from 3 to 4. That is, in Formulae (I) and (II), preferably 2 to 4 and more preferably 3 to 4 specific reactive functional groups are included in a single molecule.

In Formula (II), it is preferable that $Ar^1$ to $Ar^4$ are any one of compounds represented by Formulae (1) to (7). In Formulae (1) and (7), "$-(D)_c$"s which may be respectively linked to the $Ar^1$ to $Ar^4$ are also shown.

(1)

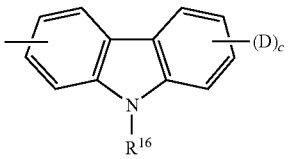

(2)

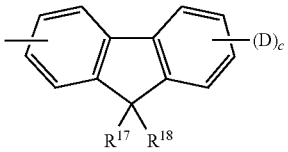

(3)

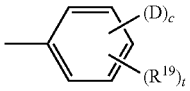

(4)

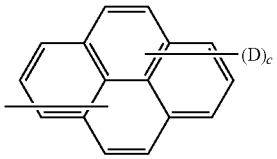

(5)

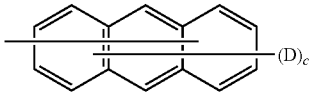

(6)

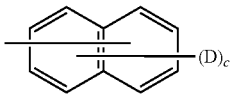

(7)

In Formulae (1) to (7), $R^{16}$ represents one kind selected from a group consisting of a hydrogen atom, an alkyl group having from 1 to 4 carbon atoms, a phenyl group which may be substituted with an alkyl group having from 1 to 4 carbon atoms or an alkoxy group having from 1 to 4 carbon atoms, an unsubstituted phenyl group, and an aralkyl group having from 7 to 10 carbon atoms; $R^{17}$ to $R^{19}$ each independently represents one kind selected from a group consisting of a hydrogen atom, an alkyl group having from 1 to 4 carbon atoms, an alkoxy group having from 1 to 4 carbon atoms, a phenyl group which may be substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c represent the same as those represented by D and c in Formula (II); s represents 0 or 1; and t represents an integer of from 1 to 3.

In this case, it is preferable that Ar in Formula (7) is represented by Formula (8) or (9) below.

(8)

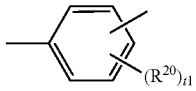

(9)

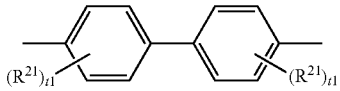

In Formulae (8) and (9), $R^{20}$ and $R^{21}$ each independently represents one kind selected from a group consisting of a hydrogen atom, an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; and t1 represents an integer of from 1 to 3.

In addition, it is preferable that Z' in Formula (7) represent any one of compounds represented by Formulae (10) to (17) below.

(10)

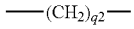

(11)

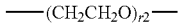

(12)

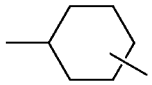

(13)

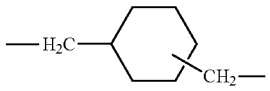

(14)

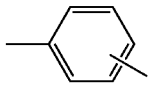

(15)

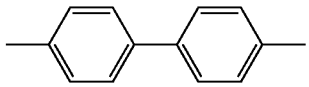

(16)

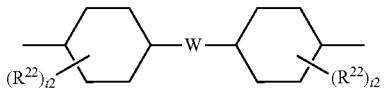

(17)

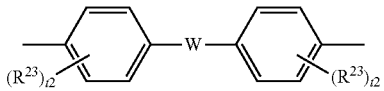

In Formulae (10) to (17), $R^{22}$ and $R^{23}$ each independently represents one kind selected from a group consisting of a hydrogen atom, an alkyl group having from 1 to 4 carbon atoms, an alkoxy group having from 1 to 4 carbon atoms or a phenyl group which is substituted with an alkoxy group having from 1 to 4 carbon atoms, an unsubstituted phenyl group, an aralkyl group having from 7 to 10 carbon atoms, and a halogen atom; W represents a divalent group; q2 and r2 each independently represents an integer of from 1 to 10; and t2 each independently represents an integer of from 1 to 3.

It is preferable that W in Formulae (16) and (17) represent any one of divalent groups represented by Formulae (18) to (26) below. In this case, in Formula (25), u represents an integer of from 0 to 3.

—$CH_2$— (18)

—$C(CH_3)_2$— (19)

—O— (20)

—S— (21)

—$C(CF_3)_2$— (22)

—$Si(CH_3)_2$— (23)

(24)

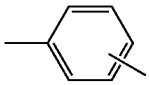

(25)

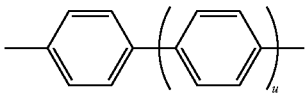

(26)

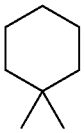

In addition, in Formula (II), it is preferable that, when k is 0, $Ar^5$ represents an aryl group represented by any one of Formulae (1) to (7), which is used as an example in the description of $Ar^1$ to $Ar^4$; and when k is 1, $Ar^5$ represents an arylene group in which a hydrogen atom is excluded from an aryl group represented by any one of Formulae (1) to (7).

Specific examples of a compound represented by Formula (1) include the following compounds (I-I) to (I-34). In this case, the compound represented by Formula (I) is not limited thereto.

I-1

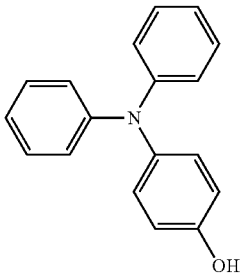

I-2

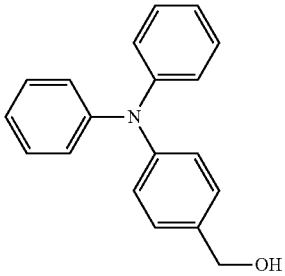

-continued

I-3

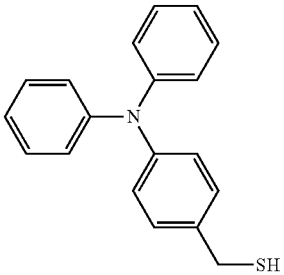

I-4

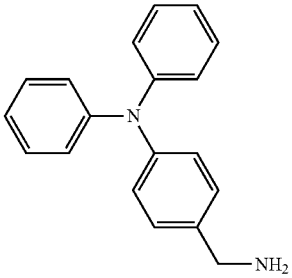

I-5

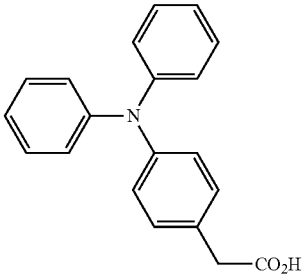

I-6

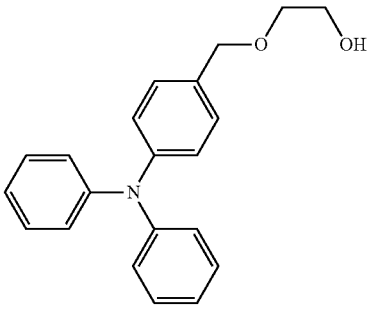

I-7

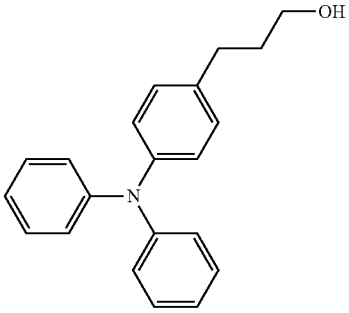

-continued
I-8
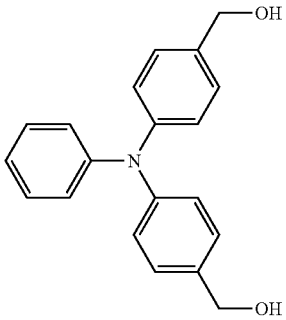
I-9
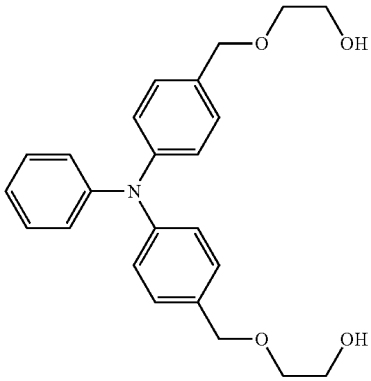
I-10
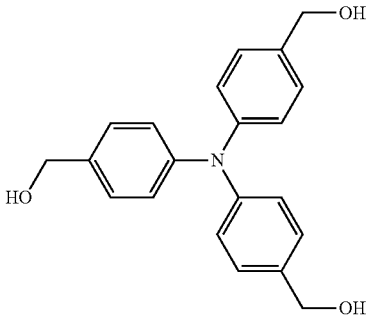
I-11
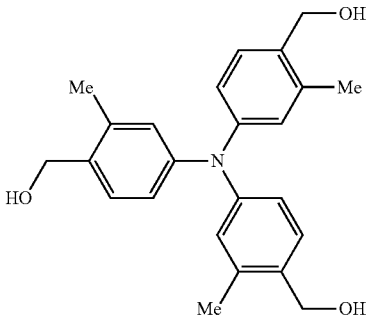
-continued
I-12
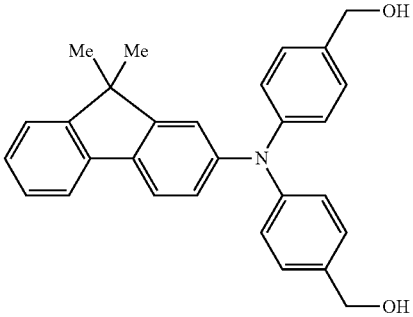
I-13
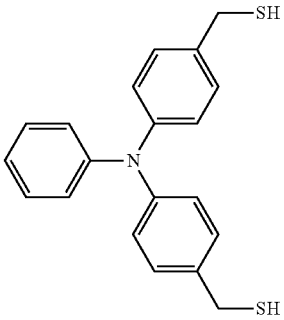
I-14
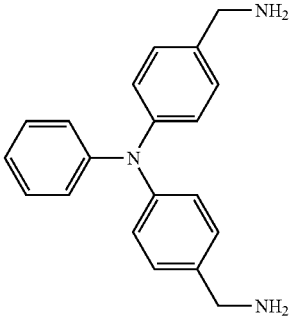
I-15
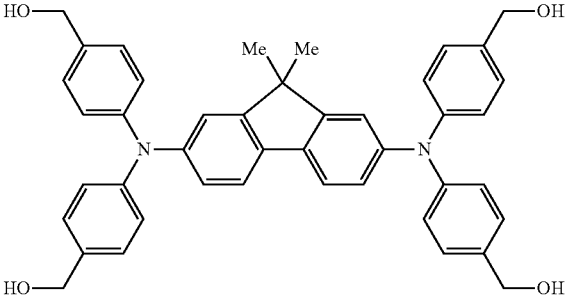
I-16
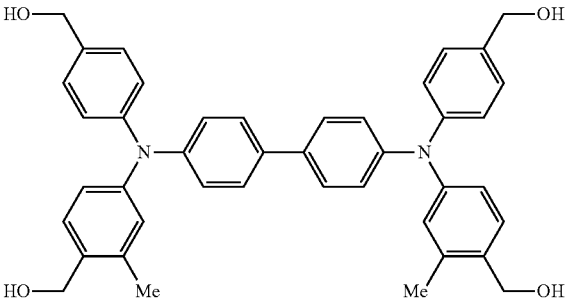

-continued
I-17
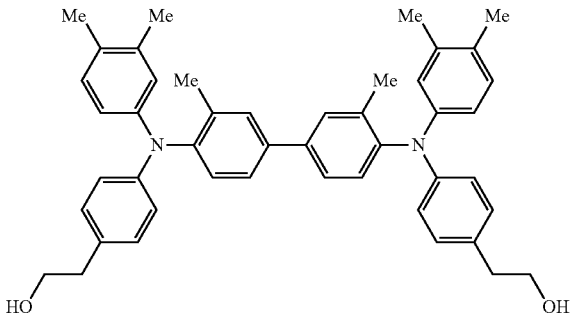
I-18
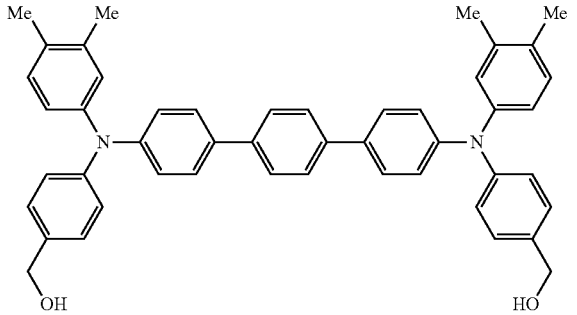
I-19
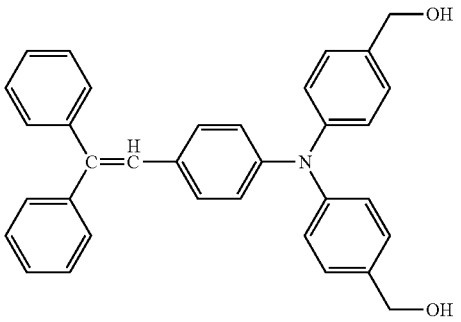
I-20
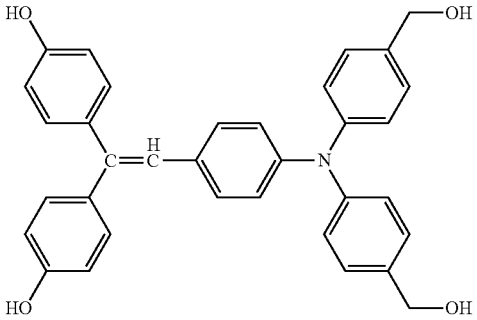
-continued
I-21
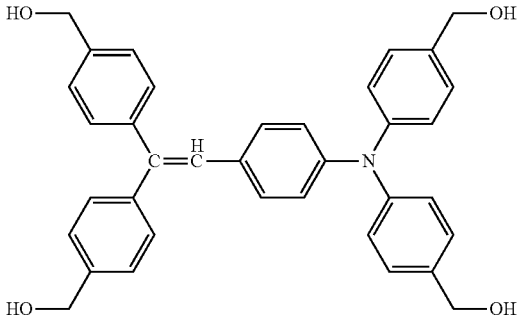
I-22
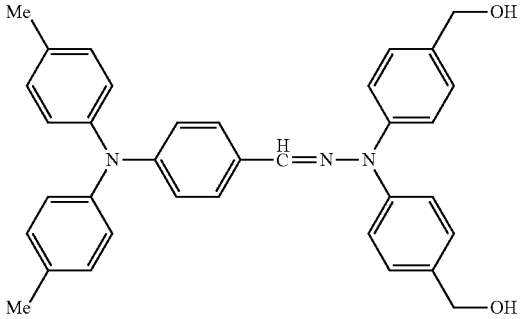
I-23
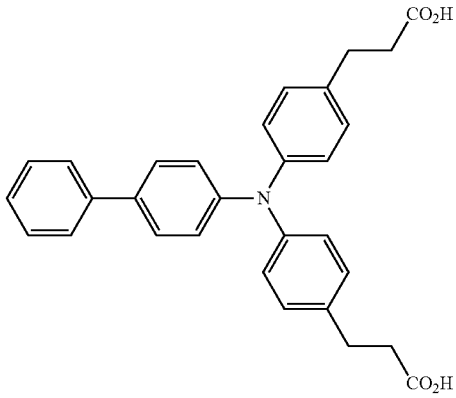
I-24
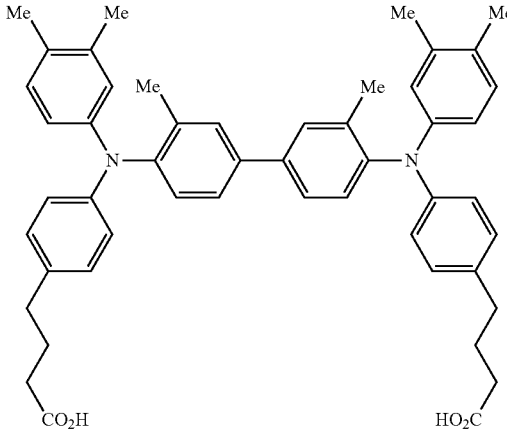

-continued
I-25
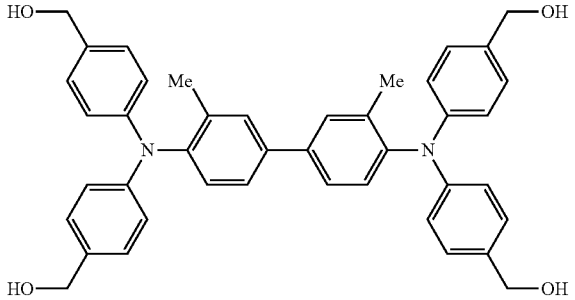
I-26
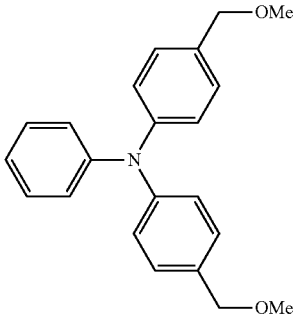
I-27
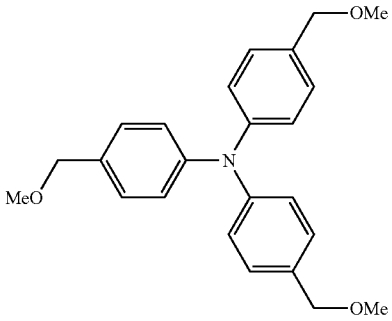
I-28
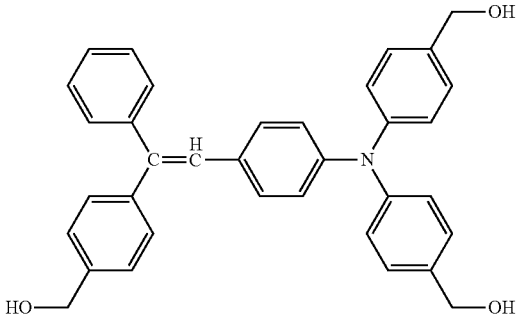
-continued
I-29
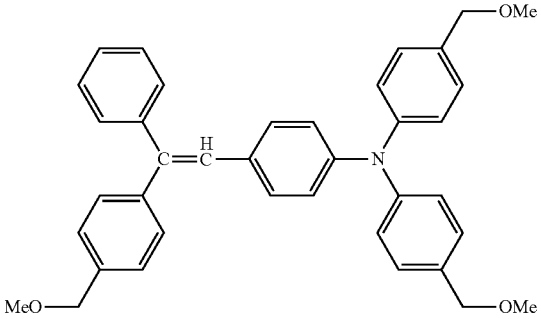
I-30
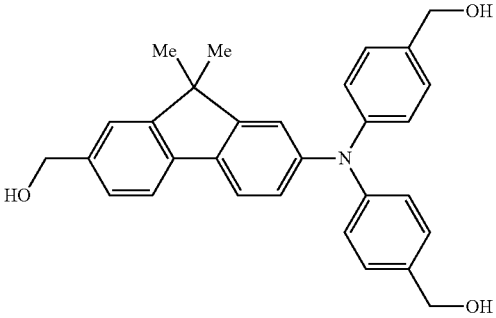
I-31
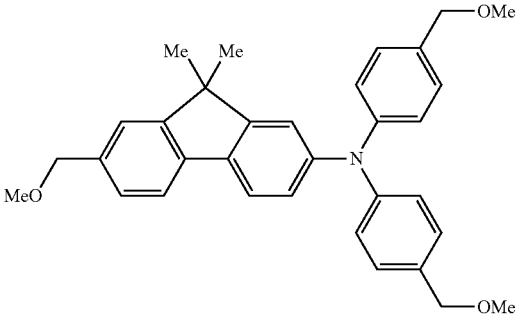
I-32
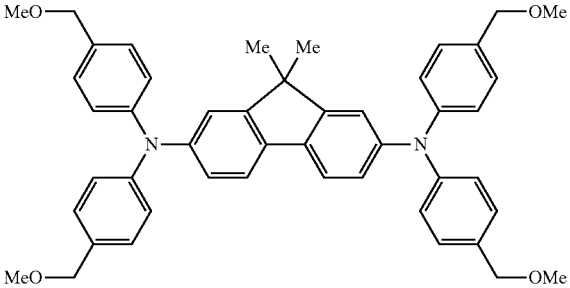

-continued

I-33

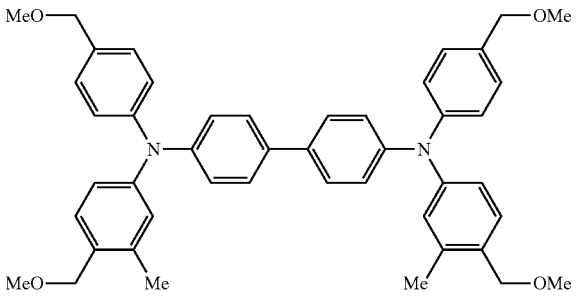

I-34

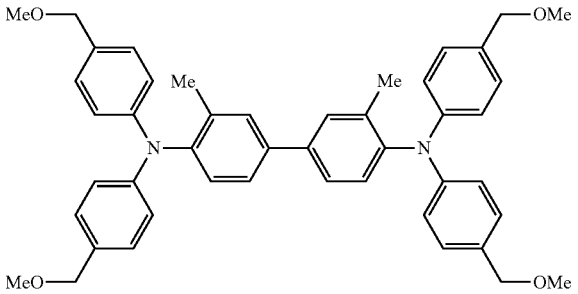

Other Components

The protective layer 5 may include other components in addition to the fluororesin particles and the specific cross-linked component. An example of other components includes the above-described copolymer having an alkyl fluoride group as a dispersing aid.

The above-described copolymer having an alkyl fluoride group is not particularly limited and for example, a fluorine-based graft polymer having a repeating unit represented by any one of Formulae (A) and (B) below may be used. Specific examples thereof include resins which are synthesized by, for example, graft polymerization using macromonomers including acrylate compounds, methacrylate compounds, and the like; and perfluoroalkylethyl (meth)acrylate and perfluoroalkyl (meth)acrylate. In this case, (meth)acrylate represents acrylate or methacrylate.

Structural Formula (A)

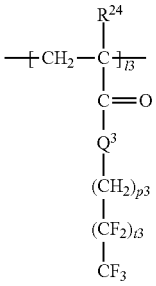

-continued

Structural Formula (B)

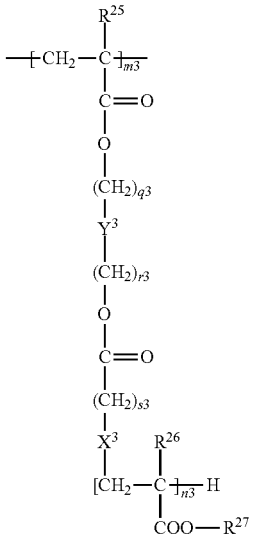

In Formulae (A) and (B), l3, m3, and n3 represent a positive number of 1 or more; p3, q3, r3, and s3 represent 0 or a positive number of 1 or more; t3 represents a positive number of 1 to 7; $R^{24}$, $R^{25}$, $R^{26}$, and $R^{27}$ represent a hydrogen atom or an alkyl group; $X^3$ represents an alkylene chain, a halogen-substituted alkylene chain, —S—, —O—, —NH—, or a single bond; $Y^3$ represents an alkylene chain, a halogen-substituted alkylene chain, —($C_{z3}H_{2z3-1}$(OH))—, or a single bond; z3 represents a positive number of 1 or more; and $Q^3$ represents —O— or —NH—.

In Formulae (A) and (B), examples of alkyl groups represented by $R^{24}$, $R^{25}$, $R^{26}$, and $R^{27}$ include a methyl group, an ethyl group, and a propyl group. It is preferable that $R^{24}$, $R^{25}$, $R^{26}$, and $R^{27}$ represent a hydrogen atom and a methyl group and it is more preferable that they represent a methyl group.

In the copolymer having an alkyl fluoride group, the ratio of content of Formula (A) and Formula (B), that is, l3:m3 is preferably from 1:9 to 9:1 and more preferably 3:7 to 7:3.

The weight average molecular weight of the copolymer having an alkyl fluoride group is preferably from 10,000 to 100,000 and more preferably from 30,000 to 100,000.

In particular, the kind of the copolymer having an alkyl fluoride group, which is preferable from the viewpoint of making values of $A_1$, $A_2$, and $A_3$ satisfy Expressions (1), (2), and (3), changes depending on the kind and the particle size of fluororesin particles and the like. For example, when PTFE particles with an average primary particle size of 0.2 μm are used as the fluororesin particles, GF400 (manufactured by TOAGOSEI CO., LTD.) is used as a preferable example of the copolymer having an alkyl fluoride group.

In the protective layer 5, as other components, for example, a mixture of the specific cross-linked component and other thermo-setting resins such as phenol resin, melamine resin, urea resin, alkyd resin, and benzoguanamine resin may be used. In addition, a compound having more functional groups in a single molecule such as spiroacetal guanamine resin (for example, "CTU-guanamine" (manufactured by Ajinomoto Fine Techno Co., Inc.)) may be copolymerized with a material in the cross-linked component.

In addition, a surfactant may be added to the protective layer 5. Preferable examples of the surfactant used include surfactants including fluorine atoms and at least one structure of an alkylene oxide structure and a silicone structure.

An antioxidant may be added to the protective layer 5. As the antioxidant, a hindered phenol or hindered amine antioxidant is preferable, and well-known antioxidants such as an organic sulfur antioxidant, a phosphite antioxidant, a dithiocarbamate antioxidant, a thiourea antioxidant, and a benzimidazole antioxidant may be used. The amount of the antioxidant added is preferably less than or equal to 20% by weight and more preferably less than or equal to 10% by weight.

Oil such as silicone oil may be added to the protective layer 5. Examples of silicone oil include silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacrylate-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl-group-containing cyclosiloxanes such as a methylhydrosiloxane mixture, pentamethylcyclopentasiloxane, phenylhydrocyclosiloxane; and vinyl-group-containing cyclosiloxanes such as pentavinylpentamethylcyclopentasiloxane.

A curing catalyst for facilitating curing of the guanamine compound, the melamine compound, and the specific charge transport material to be cured may be added to the protective layer 5. As the curing catalyst, an acidic catalyst is preferable. Examples of the acidic catalyst include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic and aromatic sulfonic acids such as methanesulfonic acid, dodecylsulfonic acid, benzenesulfonic acid, dodecylbenzenesulfonic acid, and naphthalenesulfonic acid. Among these, a sulfur-containing material is preferable.

It is preferable that the sulfur-containing material as the curing catalyst is acidic at normal temperature (for example, 25° C.) or after heating, and at least one kind of organic sulfonic acids and derivatives thereof is most preferable. Whether or not there is such a catalyst in the protective layer 5 is easily checked using energy dispersive X-ray spectroscopy (EDS), X-ray photoelectron spectroscopy (XPS), or the like.

Examples of the organic sulfonic acids and derivatives thereof include para-toluenesulfonic acid, dinonylnaphthalenesulfonic acid (DNNSA), dinonylnaphthalenedisulfonic acid (DNNDSA), dodecylbenzenesulfonic acid, and phenolsulfonic acid. Among these, para-toluenesulfonic acid and dodecylbenzenesulfonic acid are preferable. In addition, organic sulfonates may be used as long as they are dissociable in a curable resin composition.

In addition, a so-called thermally latent catalyst, in which a catalytic power is improved when heat is applied thereto, may be used Examples of the thermally latent catalyst include a microcapsule obtained by enclosing an organic sulfone compound or the like into a particle form with a polymer; a catalyst in which an acid or the like is adsorbed to a porous compound such as zeolite; a thermally latent protonic acid catalyst obtained by blocking a protonic acid and/or a protonic acid derivative with a base; a catalyst obtained by esterification of a protonic acid and/or a protonic acid derivative with a primary or secondary alcohol; a catalyst obtained by blocking a protonic acid and/or a protonic acid derivative with a vinyl ether and/or a vinylthioether; a monoethylamine complex of boron trifluoride; and a pyridine complex of boron trifluoride.

Among these, the thermally latent protonic acid catalyst obtained by blocking a protonic acid and/or a protonic acid derivative with a base is preferable.

Examples of a protonic acid used for the thermally latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzenesulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. In addition, examples of a protonic acid derivative include neutralizing substances of salts of alkaline metals or salts of alkaline earth metals of a protonic acid such as sulfonic acid and phosphoric acid; and polymers (for example, polyvinyl sulfonic acid) in which a protonic acid structure is incorporated into a polymer chain. An example of the base which blocks a protonic acid includes amines.

Examples of commercially available products include products manufactured by King Industries Inc. such as "NACURE 2501" (toluenesulfonic acid dissociation, methanol/isopropanol solvent, pH: 6.0 to 7.2, dissociation temperature: 80° C.), "NACURE 2107" (p-toluenesulfonic acid dissociation, isopropanol solvent, pH: 8.0 to 9.0, dissociation temperature: 90° C.), "NACURE 2500" (p-toluenesulfonic acid dissociation, isopropanol solvent, pH: 6.0 to 7.0, dissociation temperature: 65° C.), "NACURE 2530" (p-toluenesulfonic acid dissociation, methanol/isopropanol solvent, pH: 5.7 to 6.5, dissociation temperature: 65° C.), "NACURE 2547" (p-toluenesulfonic acid dissociation, aqueous solution, pH: 8.0 to 9.0, dissociation temperature: 107° C.), "NACURE 2558" (p-toluenesulfonic acid dissociation, ethylene glycol solvent, pH: 3.5 to 4.5, dissociation temperature: 80° C.), "NACURE XP-357" (p-toluenesulfonic acid dissociation, methanol solvent, pH: 2.0 to 4.0, dissociation temperature: 65° C.), "NACURE XP-386" (p-toluenesulfonic acid dissociation, aqueous solution, pH: 6.1 to 6.4, dissociation temperature: 80° C.), "NACURE XC-2211" (p-toluenesulfonic acid dissociation, pH: 7.2 to 8.5, dissociation temperature: 80° C.), "NACURE 5225" (dodecylbenzenesulfonic acid dissociation, isopropanol solvent, pH: 6.0 to 7.0, dissociation temperature: 120° C.), "NACURE 5414" (dodecylbenzenesulfonic acid dissociation, xylene solvent, dissociation temperature: 120° C.), "NACURE 5528" (dodecylbenzenesulfonic acid dissociation, isopropanol solvent, pH: 7.0 to 8.0, dissociation temperature: 120° C.), "NACURE 5925" (dodecylbenzenesulfonic acid dissociation, pH: 7.0 to 7.5, dissociation temperature: 130° C.), "NACURE 1323" (dinonylnaphthalenesulfonic acid dissociation, xylene solvent, pH: 6.8 to 7.5, dissociation temperature: 150° C.), "NACURE 1419" (dinonylnaphthalenesulfonic acid dissociation, xylene/methyl isobutyl ketone solvent, dissociation temperature: 150° C.), "NACURE 1557" (dinonylnaphthalenesulfonic acid dissociation, butanol/2-butoxyethanol solvent, pH: 6.5 to 7.5, dissociation temperature: 150° C.), "NACURE X49-110" (dinonylnaphthalenedisulfonic acid dissociation, isobutanol/isopropanol solvent, pH: 6.5 to 7.5, dissociation temperature: 90° C.), "NACURE 3525" (dinonylnaphthalenedisulfonic acid dissociation, isobutanol/isopropanol solvent, pH: 7.0 to 8.5, dissociation temperature: 120° C.), "NACURE XP-383" (dinonylnaphthalenedisulfonic acid dissociation, xylene solvent, dissociation temperature: 120° C.), "NACURE 3327" (dinonylnaphthalenedisulfonic acid dissociation, isobutanol/isopropanol solvent, pH: 6.5 to 7.5, dissociation temperature: 150° C.), "NACURE 4167" (phosphoric acid dissociation, isopropanol/isobutanol solvent, pH: 6.8 to 7.3, dissociation temperature: 80° C.), "NACURE XP-297" (phosphoric acid dissociation, water/isopropanol solvent, pH: 6.5 to 7.5, dissociation temperature: 90° C.), and "NACURE 4575" (phosphoric acid dissociation, pH: 7.0 to 8.0, dissociation temperature: 110° C.)

As the thermally latent catalyst, these examples may be used alone or in combination of two or more kinds.

In this case, the mixing amount of the catalyst is, for example, from 0.1% by weight to 50% by weight with respect to the total solid content of the coating solution from which the fluororesin particles and the copolymer having an alkyl fluoride group are excluded, and may be from 0.1% by weight to 30% by weight.

Method of Forming Protective Layer

A method of forming the protective layer 5 includes, for example, a process of preparing a protective-layer-forming coating solution which contains the fluororesin particles, the alkoxy compound, and the hydroxy compound; a process of coating the outer peripheral surface of the charge transport layer 3 with the protective-layer-forming coating solution; and a process of forming the protective layer 5 by curing the surface-layer-forming coating solution with which the outer peripheral surface of the charge transport layer 3 is coated.

For example, when the protective layer 5 includes the specific cross-linked component, the protective layer 5 is formed with a protective-layer-forming coating solution which contains at least one kind selected from the fluororesin particles, the guanamine compound, and the melamine compound; the charge transport material as the alkoxy compound; and the charge transport material as the hydroxy compound. The components of the protective layer are optionally added to the protective-layer-forming-solution.

The protective layer-forming coating solution may be prepared without a solvent and optionally, may be prepared using a solvent such as alcohols such as methanol, ethanol, propanol, and butanol; ketones such as acetone and methyl ethyl ketone; and ethers such as tetrahydrofuran, diethyl ether, and dioxane. As the solvent, these examples may be used alone or as a mixture of two or more kinds and it is preferable that the boiling temperature thereof is less than or equal to 100° C.

In particular, the kind of the solvent, which is preferable from the viewpoint of making values of $A_1$, $A_2$, and $A_3$ satisfy Expressions (1), (2), and (3), changes depending on the kind and the particle size of fluororesin particles, the kind and the content of the alkoxy compound, the kind and the content of the hydroxy compound, the kind and the content of the copolymer having an alkyl fluoride group, and the like.

For example, when the compound represented by Formula I-26 is used as the alkoxy compound, the compound represented by Formula I-16 is used as the hydroxy compound, PTFE particles with an average primary particle size of 0.16 μm are used as the fluororesin particles, and GF400 (manufactured by TOAGOSEI CO., LTD.) is used as the copolymer having an alkyl fluoride group, examples of the solvent include cyclopentanone, cyclohexanone, cyclopentyl methyl ether, THF, a mixed solvent of cyclopentanone and cyclopentanol, and a mixed solvent of THF and cyclopentanol. In addition, when the mixed solvent of cyclopentanone and cyclopentanol is used under the above-described conditions, the content of cyclopentanol in the mixed solvent is, for example, from 10% by weight to 90% by weight, and may be from 40% by weight to 60% by weight.

The amount of the solvent is not particularly limited, but when the amount is too small, the guanamine compound and the melamine compound are likely to be precipitated. Therefore, with respect to 1 part by weight of the guanamine compound and the melamine compound, the amount is, for example, from 0.5 part by weight to 30 parts by weight and preferably from 1 part by weight to 20 parts by weight.

In addition, when the coating solution is formed by a reaction of the above-described components, the components may be simply mixed and dissolved in the solvent, but may be heated at room temperature (for example, 25° C.) to 100° C. and preferably 30° C. to 80° C. for 10 minutes to 100 hours and preferably 1 hour to 50 hours. In addition, at this time, it is preferable that ultrasonic waves are applied thereto.

The charge transport layer 3 is coated with the protective-layer-forming coating solution according to a well-known method such as a blade coating method, a wire-bar coating method, a spray coating method, a dip coating method, a bead coating method, an air knife coating method, or a curtain coating method, and optionally, followed by heating at a temperature of 100° C. to 170° C. to be cured. As a result, the protective layer 5 is obtained.

Substrate

As the substrate 4, a conductive substrate is used, for example, a metal plate, a metal drum, and a metal belt obtained from metals such as aluminum, copper, zinc, stainless steel, chromium, nickel, molybdenum, vanadium, indium, gold, and platinum, or alloys thereof; and a paper, a plastic film, and a belt in which conductive compounds such as a conductive polymer and indium oxide or metals such as aluminum, palladium, and gold or alloys thereof are coated, deposited, or laminated. In this case, "conductive" indicates the volume resistivity being less than $10^{13}$ Ωcm.

When the photoreceptor according to the first aspect is used for a laser printer, it is preferable that the center line average roughness Ra of the substrate 4 is from 0.04 μm to 0.5 μm for the surface to be rough. However, when incoherent light is used as a light source, it is not particularly necessary for the surface to be rough.

Preferable examples of a method of obtaining a rough surface include wet honing of spraying a suspension, in which abrasive powder is suspended in water, onto substrate; centerless grinding of bringing a rotating grindstone into contact with a substrate and continuously grinding the substrate; and anode oxidation.

In addition, another preferable example of a method of obtaining a rough surface includes a method in which conductive or semi-conductive particles are dispersed in a resin to form a layer on the surface of the substrate 4 and thus a rough surface is obtained by the particles dispersed in the layer without making the surface of the substrate 4 rough.

In this case, a rough surface treatment using anode oxidation is to form an oxide film on an aluminum surface by performing anode oxidation in an electrolyte solution using aluminum as an anode. Examples of the electrolyte solution include a sulfuric acid solution and an oxalate solution. However, a porous anodic oxide film obtained through anode oxidation is chemically reactive as it is. Therefore, it is preferable that a sealing treatment is performed to seal pores of the anodic oxide film by volume expansion caused by a hydration reaction in steam under pressure or in boiling water (to which a salt of a metal such as nickel may be added) and to obtain hydrous oxide.

It is preferable that the thickness of the anodic oxide film is from 0.3 μm to 15 μm.

In addition, a treatment using an acid aqueous solution or a boehmite treatment may be performed on the substrate 4.

The process using an acidic treatment solution containing phosphoric acid, chromic acid, and hydrofluoric acid is performed as follows. First, an acidic treatment solution is prepared. As the mixing ratio of phosphoric acid, chromic acid, and hydrofluoric acid in the acidic treatment solution, it is preferable that from 10% by weight to 11% by weight of phosphoric acid, from 3% by weight to 5% by weight of chromic acid, and from 0.5% by weight to 2% by weight of hydrofluoric acid is mixed and the concentration of all of these acids is from 13.5% by weight to 18% by weight. It is preferable that the treatment temperature is from 42° C. to 48° C. It is preferable that the thickness of the coating layer is from 0.3 μm to 15 μm.

The boehmite treatment is performed by dipping the substrate in pure water at 90° C. to 100° C. for 5 minutes to 60 minutes or by bringing the substrate into contact with heated steam at 90° C. to 120° C. for 5 minutes to 60 minutes. It is preferable that the thickness of the coating layer is from 0.1 μm to 5 μm. Furthermore, anode oxidation using an electrolyte solution having lower coating-film solubility than that of the other kinds, such as adipic acid, boric acid, borate, phosphate, phthalate, maleate, benzoate, tartrate, and citrate, may follow.

Undercoat Layer

The undercoat layer 1 is configured as a layer which contains inorganic particles in a binder resin.

It is preferable that the inorganic particles have a powder resistance (volume resistivity) of $10^2$ Ω·cm to $10^{11}$ Ω·cm.

Among these, as the inorganic particles having the above-described resistance value, inorganic particles (conductive metal oxide) of tin oxide, titanium oxide, zinc oxide, zirconium oxide, or the like are preferable, and inorganic particles of zinc oxide is particularly preferable.

In addition, the surfaces of the inorganic particles may be treated, or a mixture of two or more kinds of inorganic particles which are subjected to different surface treatments or have different particle sizes, may be used. The volume average particle size of the inorganic particles is preferably from 50 nm to 2000 nm (more preferably from 60 nm to 1000 nm).

In addition, it is preferable that the BET specific surface area of the inorganic particles is greater than or equal to 10 $m^2/g$.

In addition to the inorganic particles, the undercoat layer may further include an acceptor compound. Any acceptor compounds may be used, and preferable examples thereof include electron transport materials such as quinone compounds (for example, chloranil and bromanil), tetracyanoquinodimethane compounds, fluorenone compounds (for example, 2,4,7-trinitrofluorenone and 2,4,5,7-tetranitro-9-fluorenone), oxadiazole compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone compounds, thiophene compounds, and diphenoquinone compounds (for example, 3,3',5,5'-tetra-t-butyldiphenoquinone). In particular, compounds having an anthraquinone structure are preferable. Furthermore, acceptor compounds having an anthraquinone structure such as hydroxyanthraquinone compounds, aminoanthraquinone compounds, and aminohydroxyanthraquinone compounds are preferable, and specific examples thereof include anthraquinone, alizarin, quinizarin, anthrarufin, and purpurin.

The content of the acceptor compound is not limited, and is preferably from 0.01% by weight to 20% by weight with respect to the inorganic particles. It is more preferable that the content is from 0.05% by weight to 10% by weight.

The acceptor compound may be added at the time of the coating of the undercoat layer 1 or may be attached to the surfaces of the inorganic particles in advance. Examples of attaching the acceptor compound to the surfaces of the inorganic particles include a dry method and a wet method.

When the surfaces are treated according to the dry method, the acceptor compound is added dropwise directly or after being dissolved in an organic solvent while the inorganic particles are stirred with a mixer or the like having a large shearing force, followed by spraying along with dry air or nitrogen gas. It is preferable that adding or spraying is performed at a temperature lower than the boiling temperature of the solvent. After adding and spraying, baking may follow at 100° C. or higher. The temperature and the time of baking are not particularly limited.

When the surfaces are treated according to the wet method, the inorganic particles are stirred in a solvent and dispersed with ultrasonic waves, a sand mill, an attritor, a ball mill, or the like, the acceptor compound is added and stirred or dispersed, and the solvent is removed. The solvent is removed by filtration or distillation. After the solvent is removed, baking may follow at 100° C. or higher. The temperature and the time of baking are not particularly limited. In the wet method, before a surface treatment agent is added, inorganic-particle-containing aqueous ingredients may be removed. Examples of a removal method include a method of removing the aqueous ingredients while being stirred and heated in a solvent used for the surface treatment and a method of removing the aqueous ingredients by azeotroping them with a solvent.

In addition, the surfaces of the inorganic particle may be treated before adding the acceptor compound. The surface treatment agent may be selected from well-known materials. Examples thereof include a silane coupling agent, a titanate coupling agent, an aluminum coupling agent, and a surfactant. In particular, a silane coupling agent is preferable. Furthermore, a silane coupling agent having an amino group is more preferable.

Any silane coupling agents having an amino group may be used, and specific examples thereof include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane. However, the coupling agent having an amino group is not limited thereto.

In addition, a mixture of two or more kinds of silane coupling agents may be used. Examples of a silane coupling agent which may be used in combination with the silane coupling agent having an amino group include vinyltrimethoxysilane, γ-methacryloxypropyl-tris(β-methoxyethoxy) silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the silane coupling agent is not limited thereto.

As the surface treatment method, any well-known methods may be used, but a dry method or a wet method is preferable.

In addition, the addition of the acceptor compound and the surface treatment using a coupling agent may be performed at the same time.

The amount of the silane coupling agent with respect to the inorganic particles in the undercoat layer 1 is not particularly limited, but is preferably from 0.5% by weight to 10% by weight with respect to the inorganic particles.

As the binder resin included in the undercoat layer 1, any well-known resins may be used, and examples thereof include well-known polymer resin compounds such as acetal resins (for example, polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and urethane resins; charge transport resins having a charge transport group; and conductive resins such as polyaniline. Among these, resins which are insoluble in a coating solvent of an upper layer are preferably used, and particularly preferable examples thereof include phenolic resins, phenol-formaldehyde resins, melamine resins, urethane resins, and epoxy resins. These examples may be used in combination of two or more kinds and the mixing ratio thereof is optionally set.

The ratio of the metal oxide imparted with an accepting property and the binder resin or the ratio of the inorganic particles and the binder resin in the undercoat-layer-forming coating solution is not particularly limited.

Various additives may be added to the undercoat layer 1. As the additives, well-known materials such as electron transport pigments, (for example, condensed polycyclic pigments and azo pigments), zirconium chelate compounds, titanium chelate compounds, aluminum chelate compounds, titanium alkoxide compounds, organic titanium compounds, and silane coupling agents are used. The silane coupling agent is used for the surface treatment of the metal oxide, but may be further added to the coating solution as an additive. Specific examples of the silane coupling agent used as the additive include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, ethyl acetoacetate zirconium, zirconium triethanolamine, acetylacetonate zirconium butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, ethyl acetoacetate aluminum diisopropylate, and aluminum tris(ethyl acetoacetate).

These compounds may be used alone or as a mixture or a polycondensate of plural kinds.

The solvent used for preparing the undercoat-layer-forming coating solution is selected from well-known organic solvents such as alcohols, aromatic solvents, halogenated hydrocarbons, ketones, ketone alcohols, ethers, and esters. Examples of the solvent include well-known organic solvents such as methanol, ethanol, n-propanol, iso-propanol, n-butanol, benzylalcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

In addition, as the solvent used for dispersion, the above examples may be used alone or as a mixture of two or more kinds. When a mixture of two or more kinds of solvents is used, any mixed solvents may be used as long as the binder resin is soluble therein.

Examples of a dispersion method include well-known methods using a roll mill, a ball mill, a vibration ball mill, an attritor, a sand mill, a colloid mill, and a paint shaker. Furthermore, examples of a coating method used for providing the undercoat layer 1 include well known methods such as a blade coating method, a wire-bar coating method, a spray coating method, a dip coating method, a bead coating method, an air knife coating method, and a curtain coating method.

Using the undercoat-layer-forming coating solution thus obtained, the undercoat layer 1 is formed on the substrate 4.

In addition, it is preferable that the undercoat layer 1 have a Vickers hardness of 35 or greater.

Furthermore, the thickness of the undercoat layer 1 is not limited, but it is preferable that the thickness is greater than or equal to 5 μm and more preferably from 10 μm to 40 μm.

In addition, in order to prevent moire fringe, the surface roughness (the average of surface roughnesses at ten points) of the undercoat layer 1 is adjusted to be ¼n (n represents the refractive index of an upper layer) to ½λ, of the wavelength λ of exposure laser light to be used. In order to adjust the surface roughness, particles of a resin or the like may be added to the undercoat layer. Examples of the resin particles include silicone resin particles and cross-linked polymethylmethacrylate resin particles.

In addition, in order to adjust the surface roughness, the undercoat layer may be polished. Examples of a polishing method include buffing, sand blasting, wet honing, and grinding.

The undercoat layer may be obtained by coating and drying the coating solution. In this case, in general, drying is performed at a temperature that evaporates a solvent to form the layer.

Charge Generation Layer

It is preferable that the charge generation layer 2 at least include a charge generation material and a binder resin.

Examples of the charge generation material include azo pigments such as bisazo and trisazo, condensed aromatic pigments such as dibromoanthanthrone, perylene pigments, pyrrolopyrrole pigments, phthalocyanine pigments, zinc oxide, and trigonal selenium. Among these, for exposure laser light in the near-infrared range, metal phthalocyanine pigments and/or metal-free phthalocyanine pigments are preferable. In particular, hydroxygallium phthalocyanines disclosed in JP-A-5-263007 and JP-A-5-279591, chlorogallium phthalocyanine disclosed in JP-A-5-98181, dichlorotin phthalocyanines disclosed JP-A-5-140472 and JP-A-5-140473, and titanyl phthalocyanines disclosed in JP-A-4-189873 and JP-A-5-43823 are preferable. In addition, for laser light in the near-ultraviolet range, condensed aromatic pigments such as dibromoanthanthrone, thioindigo pigments, porphyrazine compounds, zinc oxide, and trigonal selenium are more preferable. As the charge generation material, when a light source which emits exposure light having a wavelength of 380 nm to 500 nm is used, inorganic pigments are preferable, and when a light source which emits exposure light having a wavelength of 700 nm to 800 nm is used, metal phthalocyanine pigments and metal-free phthalocyanine pigments are preferable.

As the charge generation material, in an absorption spectrum having a wavelength range of 600 nm to 900 nm, hydroxygallium phthalocyanine pigment having a maximum peak wavelength in a range of 810 nm to 839 nm is preferable. This hydroxygallium phthalocyanine pigment is different from V-type hydroxygallium phthalocyanine pigment of the related art and has a maximum peak wavelength which is shifted further to the short wavelength side than the related art in the absorption spectrum.

In addition, in the hydroxygallium phthalocyanine pigment having a maximum peak wavelength of 810 nm to 839 nm, it is preferable that the average particle size is in a specific range and the BET specific surface area is in a specific range. Specifically, the average particle size is preferably less than or equal to 0.20 μm and more preferably from 0.01 μm to 0.15 μm, and the BET specific surface area is preferably greater than or equal to 45 $m^2/g$, more preferably greater than or equal to 50 $m^2/g$, and still more preferably from 55 $m^2/g$ to 120 $m^2/g$. The average particle size is measured as a volume average particle size (d50 average particle size) using a laser diffraction scattering particle size distribution analyzer (LA-700, manufactured by HORIBA Ltd.). In addition, the BET specific surface area is measured using a BET specific surface area measuring instrument (manufactured by Shimadzu Corporation, FLOWSORB 112300) according to a nitrogen substitution method.

In addition, the maximum particle size (maximum value of primary particle sizes) of the hydroxygallium phthalocyanine pigment is preferably less than or equal to 1.2 μm, more preferably less than or equal to 1.0 μm, and still more preferably less than or equal to 0.3 μm.

Furthermore, in the hydroxygallium phthalocyanine pigment, it is preferable that the average particle size is less than or equal to 0.2 μm, the maximum particle size is less than or equal to 1.2 μm, and the BET specific surface area is greater than or equal to 45 $m^2/g$.

In addition, in an X-ray diffraction spectrum using CuKa characteristic X-rays, it is preferable that the hydroxygallium phthalocyanine pigment has diffraction peaks at Bragg angles $(2\theta\pm0.2)°$ of 7.5°, 9.9°, 12.5°, 16.3°, 18.6°, 25.1°, and 28.3°.

In addition, when the hydroxygallium phthalocyanine pigment is heated from 25° C. to 400° C., the decrease rate in thermogravimetry is preferably from 2.0% to 4.0% and more preferably from 2.5% to 3.8%.

The binder resin used for the charge generation layer 2 is selected from a wide range of insulating resins and may be selected from organic photoconductive polymers such as poly-N-vinyl carbazole, polyvinyl anthracene, polyvinyl pyrene, and polysilane. Preferable examples of the binder resin include polyvinyl butyral resins, polyarylate resins (for example, polycondensates of bisphenols and aromatic divalent carboxylic acids), polycarbonate resins, polyester resins, phenoxy resins, vinyl chloride-vinyl acetate copolymers, polyimide resins, acrylic resins, polyacrylamide resins, polyvinyl pyridine resins, cellulose resins, urethane resins, epoxy resins, casein, polyvinyl alcohol resins, and polyvinyl pyrrolidone resins. As the binder resin, the above examples may be used alone or as a mixture of two or more kinds. It is preferable that the mixing ratio of the charge generation material and the binder resin is from 10:1 to 1:10. In this case, "insulating" indicates the volume resistivity being greater than or equal to $10^{13}$ Ωcm.

The charge generation layer 2 is formed using, for example, a coating solution in which the charge generation material and the binder resin are dispersed in a solvent.

Examples of the solvent used for the dispersion include methanol, ethanol, n-propanol, n-butanol, benzylalcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. As the solvent, the above examples may be used alone or as a mixture of two or more kinds.

In addition, examples of a method of dispersing the charge generation material and the binder resin in a solvent include well-known methods such as a ball mill dispersion method, an attritor dispersion method, and a sand mill dispersion method. Furthermore, for this dispersion, it is effective when the average particle size of the charge generation material is preferably less than or equal to 0.5 μm, more preferably less than or equal to 0.3 μm, and still more preferably less than or equal to 0.15 μm.

In addition, the charge generation layer 2 is formed using a well-known method such as a blade coating method, a wire-bar coating method, a spray coating method, a dip coating method, a bead coating method, an air knife coating method, or a curtain coating method.

The thickness of the charge generation layer 2 thus obtained is preferably from 0.1 μm to 5.0 μm and more preferably from 0.2 μm to 2.0 μm.

Charge Transport Layer

The charge transport layer 3 is preferably a layer at least including a charge transport layer and a binder resin, or a layer including a polymer charge transport material.

Examples of the charge transport materials include electron transport compounds such as quinone compounds (such as p-benzoquinone, chioranil, bromanil, and anthraquinone) tetracyanoquinodimethane compounds, fluorenone compounds (for example, 2,4,7-trinitrofluorenone), xanthone compounds, benzophenone compounds, cyanovinyl compounds, and ethylene compounds; and hole transport compounds such as triarylamine compounds, benzidine compounds, arylalkane compounds, aryl-substituted ethylene compounds, stilbene compounds, anthracene compounds, or hydrazone compounds. As the charge transport materials, the above examples may be used alone or as a mixture of two or more kinds, but the charge transport materials are not limited thereto.

It is preferable that the charge transport materials are a triarylamine derivative represented by Formula (a-1) below and a benzidine derivative represented by Formula (a-2) below, from the viewpoint of charge mobility.

(a-1)

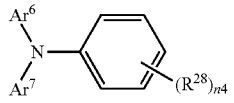

In Formula (a-1), $R^{28}$ represents a hydrogen atom or a methyl group. n4 represents 1 or 2. $Ar^6$ and $Ar^7$ each independently represents a substituted or unsubstituted aryl group, $—C_6H_4—C(R^{29})=C(R^{30})(R^{30})$, or $—C_6H_4—CH=CH—CH=C(R^{32})(R^{33})$; and $R^{29}$ to $R^{33}$ each independently represents a hydrogen atom, a substituted or unsubstituted alkyl group, or a substituted or unsubstituted aryl group. Examples of a substituent include a halogen atom, an alkyl group having from 1 to 5 carbon atoms, an alkoxy group having from 1 to 5 carbon atoms, or a substituted amino group having a substituent of an alkyl group having from 1 to 3 carbon atoms.

(a-2)

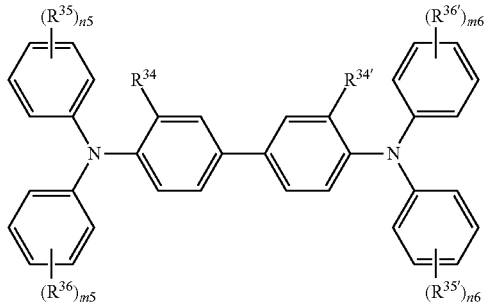

In Formula (a-2), $R^{34}$ and $R^{34'}$ may be the same as or different from each other, and each independently represents a hydrogen atom, a halogen atom, an alkyl group having from 1 to 5 carbon atoms, or an alkoxy group having from 1 to 5 carbon atoms. $R^{35}$, $R^{35'}$, $R^{36}$, and $R^{36'}$ may be the same as or different from each other, and each independently represents a hydrogen atom, a halogen atom, an alkyl group having from 1 to 5 carbon atoms, an alkoxy group having from 1 to 5 carbon atoms, an amino group having a substituent of an alkyl group having 1 or 2 carbon atoms, a substituted or unsubstituted aryl group, —C($R^{37}$)═C($R^{38}$)($R^{39}$), or —CH═CH—CH═C($R^{40}$)($R^{41}$), in which $R^{37}$ to $R^{41}$ each independently represents a hydrogen atom, a substituted or unsubstituted alkyl group, or a substituted or unsubstituted aryl group. m5, m6, n5, and n6 each independently represents an integer of 0 to 2.

In this case, among triarylamine derivatives represented by Formula (a-1) and benzidine derivatives represented by Formula (a-2), a triarylamine derivative having a structure of "—$C_6H_4$—CH═CH—CH═C($R^{32}$)($R^{33}$)" and benzidine derivative having a structure of "—CH═CH—CH═C($R^{40}$)($R^{41}$)" are preferable.

Examples of the binder resins used for the charge transport layer 3 (resin for the charge transport layer) include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole, and polysilane. In addition, as described above, polymer charge transport materials such as polyester-based polymer charge transport materials disclosed in JP-A-8-176293 and JP-A-8-208820 may be used. As the binder resin, the above examples may be used alone or as a mixture of two or more kinds. It is preferable that the mixing ratio of the charge transport materials and the binder resin is from 10:1 to 1:5.

The binder resin is not particularly limited, but at least one kind of polycarbonate resins having a viscosity average molecular weight of 50,000 to 80,000 and polyarylate resins having a viscosity average molecular weight of 50,000 to 80,000 is preferable.

In addition, as the charge transport materials, a polymer charge transport material may be used. As the polymer charge transport material, well-known materials having a charge transport function such as poly-N-vinylcarbazole and polysilane may be used. In particular, polyester-based polymer charge transport materials disclosed in JP-A-8-176293 and JP-A-8-208820 are preferable. The layer may be formed using the polymer charge transport material alone or a mixture of the polymer charge transport material and the binder resin described later.

The charge transport layer 3 is formed using, for example, a charge-transport-layer-forming coating solution which contains the above-described components. Examples of a solvent used for the charge-transport-layer-forming coating solution include well-known organic solvents for example, aromatic hydrocarbons such as benzene, toluene, xylene, and chlorobenzene; ketones such as acetone or 2-butanone; halogenated aliphatic hydrocarbons such as methylene chloride, chloroform, and ethylene chloride; and cyclic or linear ethers such as tetrahydrofuran and ethyl ether. These examples may be used alone or as a mixture of two or more kinds. In addition, as a method of dispersing the above-described components, a well-known method is used.

Examples of a coating method for coating the charge generation layer 2 with the charge-transport-layer-forming coating solution include well-known methods such as a blade coating method, a wire-bar coating method, a spray coating method, a dip coating method, a bead coating method, an air knife coating method, and a curtain coating method.

The thickness of the charge transport layer 3 is preferably from 5 μm to 50 μm and more preferably from 10 μm to 30 μm.

In the electrophotographic photoreceptors 7A to 7C illustrated in FIGS. 1 to 3, additives such as an antioxidant, a photostabilizer, and a thermal stabilizer may be added to the respective layers constituting the photosensitive layer. Examples of the antioxidant include hindered phenol, hindered amine, paraphenylenediamine, arylalkane, hydroquinone, spirochroman, and spiroindanone and derivatives thereof; organic sulfur compounds; and organic phosphorus compounds.

Examples of the photostabilizer include derivatives such as benzophenone, benzotriazole, dithiocarbamate, and tetramethylpiperidine.

In addition, the photosensitive layer may include an electron-accepting material. Examples of the electron-accepting material include succinic anhydride, maleic anhydride, dibromo maleic anhydride, phthalic anhydride, tetrabromo phthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and curable resins used for the surface layer.

Furthermore, the surface layers 5 of the electrophotographic photoreceptors 7A to 7C illustrated in FIGS. 1 to 3 may be treated with an aqueous dispersion containing fluororesin.

Process Cartridge and Image Forming Apparatus

Next, a process cartridge and an image forming apparatus using the electrophotographic photoreceptor according to the exemplary embodiment will be described.

The process cartridge according to the exemplary embodiment is not particularly limited as long as it uses the electrophotographic photoreceptor according to the exemplary embodiment. Specifically, it is preferable that the process cartridge according to the exemplary embodiment is detachable from an image forming apparatus that transfers a toner image, which is obtained by developing an electrostatic latent image on a surface of a latent image holding member, onto a recording medium and forms an image on the recording medium; and include the electrophotographic photoreceptor according to the exemplary embodiment as the latent image holding member and at least one selected from a charging device, a developing device, and a cleaning device.

For example, the process cartridge according to the exemplary embodiment may include the electrophotographic photoreceptor according to the exemplary embodiment; and at least one unit selected from a charging unit that charges a surface of the electrophotographic photoreceptor; a latent image forming unit that forms an electrostatic latent image on a charged surface of the electrophotographic photoreceptor; a developing unit that develops the electrostatic latent image formed on the surface of the electrophotographic photoreceptor by using a toner to form a toner image; a transfer unit that transfers the toner image, which is formed on the surface of the electrophotographic photoreceptor, onto a recording medium; and a cleaning unit that cleans the electrophotographic photoreceptor.

In addition, the image forming apparatus according to the exemplary embodiment is not particularly limited as long as it uses the electrophotographic photoreceptor according to the exemplary embodiment. Specifically, it is preferable that the image forming apparatus according to the exemplary embodiment include the electrophotographic photoreceptor according to the exemplary embodiment; a charging unit that charges a surface of the electrophotographic photoreceptor; a latent image forming unit that forms an electrostatic latent image on a charged surface of the electrophotographic photoreceptor; a developing unit that develops the electrostatic latent image formed on the surface of the electrophotographic photoreceptor by using a toner to form a toner image; and a transfer device that transfers the toner image, which is formed on the surface of the electrophotographic photoreceptor, onto a recording medium. The image forming apparatus according to the exemplary embodiment may be a so-called tandem apparatus which includes plural photoreceptors corresponding to the toner of respective colors. In this case, it is preferable that all the photoreceptors are the electrophotographic photoreceptor according to the exemplary embodiment. In addition, the toner image may be transferred according to an intermediate transfer method using an intermediate transfer member.

Figure 4:
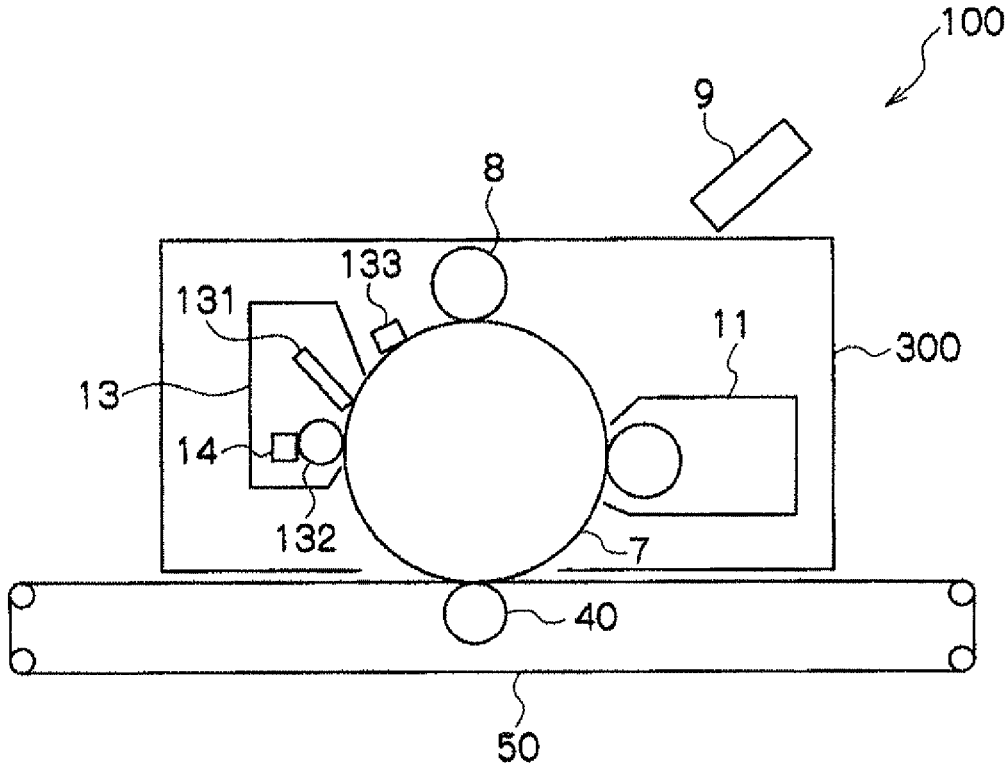
FIG. 4 is a diagram schematically illustrating a configuration of an image forming apparatus according to an exemplary embodiment.

FIG. 4 is a diagram schematically illustrating an image forming apparatus according to the exemplary embodiment. As illustrated in FIG. 4, an image forming apparatus 100 includes a process cartridge 300 including an electrophotographic photoreceptor 7, an exposure device 9, a transfer device 40 and an intermediate transfer member 50. In the image forming apparatus 100, the exposure device 9 is disposed at a position that may expose the electrophotographic photoreceptor 7 to light through an opening of the process cartridge 300; the transfer device 40 is disposed at a position facing the electrophotographic photoreceptor 7 with the intermediate transfer member 50 interposed therebetween; and the intermediate transfer medium 50 is disposed such that a part thereof is in contact with the electrophotographic photoreceptor 7.

In FIG. 4, the process cartridge 300 integrally supports the electrophotographic photoreceptor 7, a charging device 8, a developing device 11, and a cleaning device 13 in a housing. The cleaning device 13 has a cleaning blade (cleaning member). The cleaning blade 131 is disposed in contact with the surface of the electrophotographic photoreceptor 7.

In addition, an example of using a fibrous member 132 (roll-shape member) that supplies a lubricant 14 to the surface of the photoreceptor 7 and a fibrous member 133 (flat-brush-shape member) that assists cleaning is illustrated in the drawing, but these members may not be used.

As the charging device 8, a contact charger using, for example, a conductive or semi-conductive charging roller, charging brush, charging film, charging rubber blade, or charging tube is used. In addition, a non-contact roller charger, a well-known charger such as a scorotron charger or a corotron charger using corona discharge, or the like may also be used.

In addition, although not illustrated in the drawing, a photoreceptor heating member for raising the temperature of the electrophotographic photoreceptor 7 to reduce a relative temperature may be provided in the vicinity of the electrophotographic photoreceptor 7.

As the exposure device 9, for example, an optical device or the like, which exposes the surface of the electrophotographic photoreceptor 7 to light such as semiconductor laser light, LED light, or liquid crystal shutter light according to a predetermined image form, is used. The wavelength of a light source may be set in the spectral sensitivity range of a photoreceptor. The wavelength of a semiconductor laser light is mainly set in the near-infrared range having an oscillation wavelength of 780 nm. However, the wavelength is not limited thereto, and a laser having an oscillation wavelength of about 600 nm or a laser having an oscillation wavelength of 400 nm to 450 nm as a blue-light laser may also be used. In addition, a surface-emitting laser light source, which may emit multiple beams, may also be effectively used for color image formation.

As the developing device 11, a general developing device, which performs developing with or without the contact of a magnetic or non-magnetic single-component developer or a two-component developer, may be used. The developing device is not particularly limited as long as it has the above-described function and may be selected according to the purpose. For example, a well-known developing unit, which has a function of attaching a single-component developer or a two-component developer to the electrophotographic photoreceptor 7 using a brush, a roller, or the like, may be used. Among these, it is preferable that a developing roller of which the surface holds a developer is used.

As the transfer device 40, for example, a well-known transfer charger such as a contact transfer charger using a belt, a roller, a film, a rubber blade, or the like; or a scorotron transfer charger or a corotron transfer charger using corona discharge is used.

As the intermediate transfer member 50, a semi-conductive belt-shape member (intermediate transfer belt) made of polyimide, polyamidimide, polycarbonate, polyarylate, polyester, rubber or the like is used. In addition, the intermediate transfer member 50 may have a drum shape in addition to a belt shape.

In addition to the above-described devices, the image forming apparatus 100 may further include an optical static eliminator which eliminates the charge of the electrophotographic photoreceptor 7.

Figure 5:
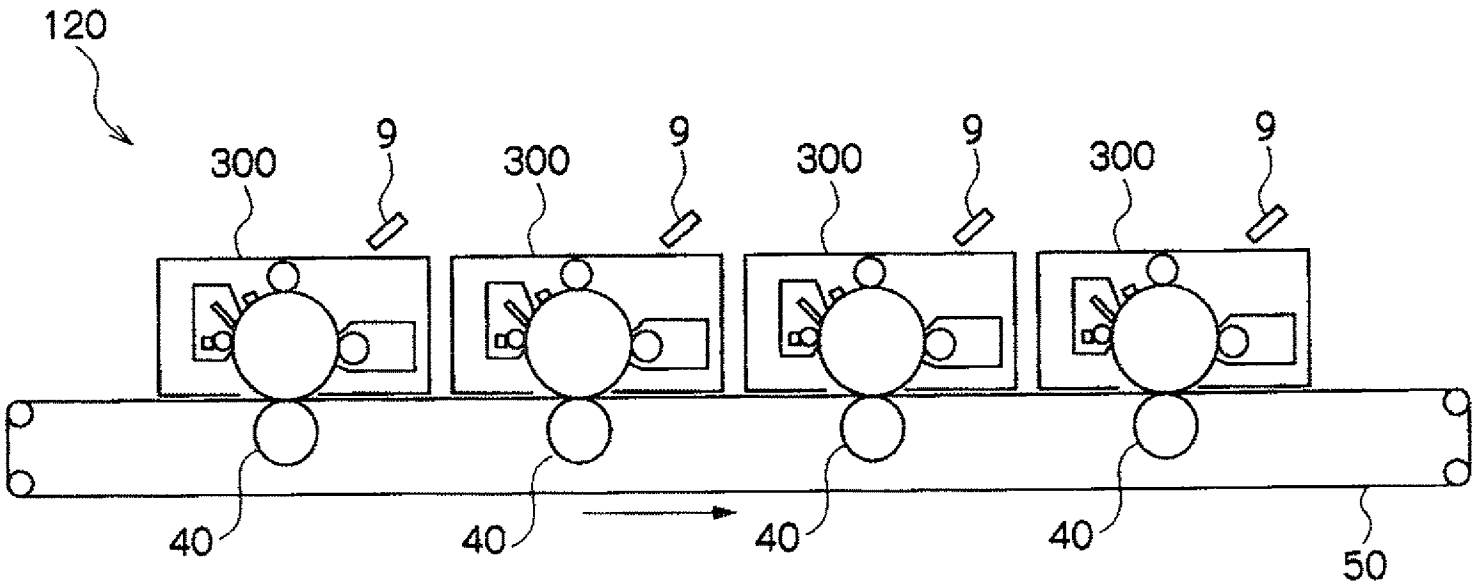
FIG. 5 is a diagram schematically illustrating a configuration of an image forming apparatus according to another exemplary embodiment.

FIG. 5 is a cross-sectional view schematically illustrating an image forming apparatus according to another exemplary embodiment of the invention. As illustrated in FIG. 5, an image forming apparatus 120 is a tandem type multi-color image forming apparatus to which four process cartridges 300 are mounted. In the image forming apparatus 120, the four process cartridges 300 are disposed in parallel on the intermediate transfer member 50 and an electrophotographic photoreceptor for each color is used. In addition, the image forming apparatus 120 has the same configuration as that of the image forming apparatus 100 except for the tandem-type configuration.

In addition, in the image forming apparatus (process cartridge) according to the exemplary embodiment, it is preferable that the developing device (developing unit) have a developer holding member having a magnetic material and develop an electrostatic latent image using a two-component developer which contains a magnetic carrier and toner.

EXAMPLES

Hereinafter, the exemplary embodiment will be described more specifically with reference to Examples and Comparative Examples, but is not limited to the following examples.

Example 1

Photoreceptor 1

Formation of Undercoat layer 100 parts by weight of zinc oxide (average particle size: 70 nm, manufactured by TAYCA CORPORATION, specific surface area: 15 $m^2/g$) and 500 parts by weight of toluene are stirred and mixed and 1.25 parts by weight of KB M 603 (manufactured by Shin-Etsu Chemical Co., Ltd.) as a silane coupling agent is added thereto, followed by stirring for 2 hours. Next, toluene is removed by distillation under reduced pressure, followed by baking at 120° C. for 3 hours. As a result, zinc oxide particles with surfaces treated with a silane coupling agent are obtained.

100 parts by weight of zinc oxide particles with the treated surfaces are added to 500 parts by weight of tetrahydrofuran, followed by stirring and mixing. Then, a solution in which 1 part by weight of alizarin is dissolved in 50 parts by weight of tetrahydrofuran is added thereto, followed by stirring at 50° C. for 5 hours. Next, zinc oxide particles with alizarin added are separated through filtration under reduced pressure, followed by drying under reduced pressure at 60° C. As a result, zinc oxide particles with alizarin added are obtained.

60 parts by weight of the obtained zinc oxide particles with alizarin added, 13.5 parts by weight of blocked isocyanate (SUMIDUR 3173, manufactured by Sumitomo Bayer Urethane Co., Ltd.) as a curing agent, and 15 parts by weight of butyral resin (BM-1, manufactured by SEKISUI CHEMICAL CO. LTD.) are dissolved in 85 parts by weight of methyl ethyl ketone to obtain a solution. 38 parts by weight of the obtained solution and 25 parts by weight of methyl ethyl ketone are mixed, followed by dispersion with a sand mill for 2 hours using glass beads with a diameter of 1 mm. As a result, a dispersion is obtained.

0.005 part by weight of dioctyl tin dilaurate as a catalyst and 40 parts by weight of silicone resin particles (TOSPEARL 145, manufactured by GE Toshiba Silicones Co., Ltd.) are added to the obtained dispersion, followed by drying and curing at 170° C. for 40 minutes. As a result, an undercoat-layer-forming coating solution is obtained. This coating solution is dip-coated on an aluminum substrate having a diameter of 60 mm, a length of 357 mm, and a thickness of 1 mm. As a result, an undercoat layer with a thickness of 20 μm is obtained.

Formation of Charge Generation Layer

Next, 1 part by weight of chlorogallium phthalocyanine crystal (as a charge generation material) having distinct diffraction peaks at Bragg angles) (2θ±0.2°) with respect to CuKα characteristic X-rays of at least 7.4°, 16.6°, 25.5°, and 28.3° and 1 part by weight of polyvinyl butyral resin (trade name: S-LEC BM-S, manufactured by SEKISUI CHEMICAL CO., LTD.) are added to 100 parts by weight of butyl acetate, followed by dispersion for 1 hour with a paint shaker using glass beads. The obtained coating solution is dip-coated on the surface of the undercoat layer, followed by drying at 100° C. for 10 minutes. As a result, a charge generation layer with a thickness of 0.2 μm is formed.

Formation of Charge Transport Layer

Furthermore, 2.1 parts by weight of Compound 1 represented by the following formula and 2.9 parts by weight of polymer compound represented by Formula 1 below (viscosity average molecular weight: 39,000) are dissolved in 10 parts by weight of tetrahydrofuran and 5 parts by weight of toluene. As a result, a coating solution is obtained. The obtained coating solution is dip-coated on the surface of the charge generation layer, followed by heat drying at 135° C. for 35 minutes. As a result, a charge transport layer with a thickness of 24 μm is formed.

Compound 1

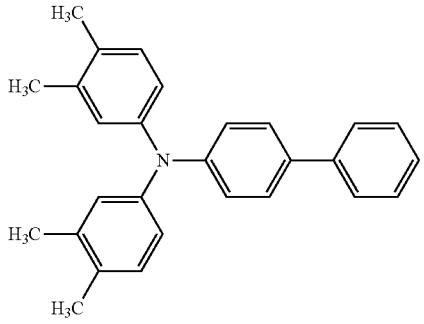

Structural Formula 1

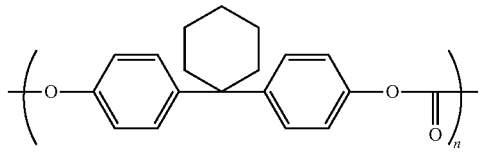

Formation of Protective Layer 10 parts by weight of LUBRON L-2 (manufactured by DAIKIN INDUSTRIES Ltd., average primary particle size: 0.2 μm) as polytetrafluoroethylene particles and 0.5 part by weight of copolymer having an alkyl fluoride group which includes a repeating unit represented by Formula 2 (weight average molecular weight: 50,000; l3:m3=1:1; s3=1; n3=60) are added to 40 parts by weight of mixed solvent obtained by mixing cyclopentanone and cyclopentanol at 7:3, followed by stirring and mixing. Dispersion is repeatedly performed five times under increased pressure to 700 $kgf/cm^2$ using a high-pressure homogenizer (manufactured by Yoshida Kikai Co., Ltd., YSNM-1500AR) to which a pass-through chamber having a flow path is mounted. As a result, Polytetrafluoroethylene particle suspension (A) is prepared.

Structural Formula 2

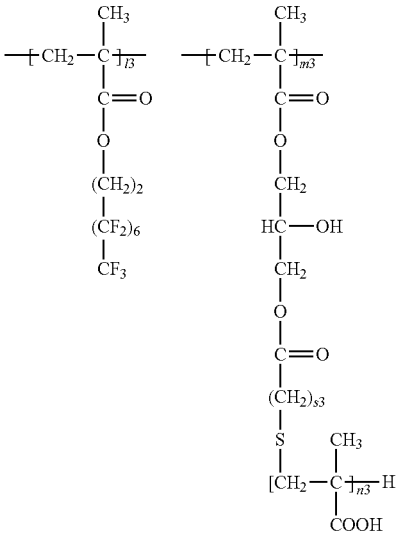

Next, 55 parts by weight of compound represented by Formula I-8 above, 40 parts by weight of compound represented by Formula I-26 above, 4 parts by weight of benzoguanamine resin (NIKALAC BL-60, manufactured by SANWA CHEMICAL CO., LTD.), 1 part by weight of dimethylpolysiloxane (GLANOL 450, manufactured by KYOEISHA CHEMICAL CO., LTD.), and 0.1 parts by weight of NACURE 5225 (manufactured by King Industries Inc.) are dissolved in a mixed solvent obtained by mixing cyclopentanone and cyclopentanol at 7:3, followed by stirring at 40° C. for 6 hours. As a result, Curable-film-forming solution (B) is obtained.

Furthermore, 110 parts by weight of Polytetrafluoroethylene particle suspension (A) and 100 parts by weight of Curable-film-forming solution (B) are mixed to prepare a protective-layer-forming coating solution.

The obtained protective-layer-forming coating solution is coated on the charge transport layer according to an ink jet coating method, followed by drying at 155° C. for 35 minutes. As a result, Photoreceptor 1 in which a protective layer with a thickness of 6 μm is formed is obtained.

Example 2

Photoreceptor 2

Photoreceptor 2 is prepared with the same preparation method as that of Photoreceptor 1, except that, when a protective layer is formed, 72 parts by weight of compound represented by Formula I-8 and 23 parts by weight of compound represented by Formula I-26 are used to form Curable-film-forming solution (B).

Example 3

Photoreceptor 3

Photoreceptor 3 is prepared with the same preparation method as that of Photoreceptor 1, except that, when a protective layer is formed, 60 parts by weight of compound represented by Formula I-8 and 35 parts by weight of compound represented by Formula I-26 are used and furthermore cyclopentyl methyl ether is used instead of the solvent used for the preparation of Polytetrafluoroethylene particle suspension (A) and the solvent used for the preparation of Curable-film-forming solution (B).

Comparative Example 1

Photoreceptor 4

Photoreceptor 4 is prepared with the same preparation method as that of Photoreceptor 1, except that, when a protective layer is formed, only 95 parts by weight of compound represented by Formula I-8 is used and only cyclopentanone is used instead of the solvent used for the preparation of Polytetrafluoroethylene particle suspension (A) and the solvent used for the preparation of Curable-film-forming solution (B).

Comparative Example 2

Photoreceptor 5

Photoreceptor 5 is prepared with the same preparation method as that of Photoreceptor 1, except that, when a protective layer is formed, 15 parts by weight of compound represented by Formula I-8 and 80 parts by weight of compound represented by Formula I-26 are used to form Curable-film-forming solution (B).

Comparative Example 3

Photoreceptor 6

Photoreceptor 6 is prepared with the same preparation method as that of Photoreceptor 3, except that, when a protective layer is formed, 55 parts by weight of compound represented by Formula I-8 and 40 parts by weight of compound represented by Formula I-26 are used and furthermore cyclopentyl methyl ether is used instead of the solvent used for the preparation of Polytetrafluoroethylene particle suspension (A) and the solvent used for the preparation of Curable-film-forming solution (B).

Comparative Example 4

Photoreceptor 7

Photoreceptor 7 is prepared with the same preparation method as that of Photoreceptor 1, except that, when a protective layer is formed, a mixed solvent obtained by mixing cyclopentanone and cyclopentanol at 45:55 is used instead of the solvent used for the preparation of Polytetrafluoroethylene particle suspension (A) and the solvent used for the preparation of Curable-film-forming solution (B).

Comparative Example 5

Photoreceptor 8

Photoreceptor 8 is prepared with the same preparation method as that of Photoreceptor 1, except that, when a protective layer is formed, 75 parts by weight of compound represented by Formula I-8 and 20 parts by weight of compound represented by Formula I-26 are used to form Curable-film-forming solution (B).

Example 4

Photoreceptor 9

Photoreceptor 9 is prepared with the same preparation method as that of Photoreceptor 1, except that, when a protective layer is formed, the amount of polytetrafluoroethylene particles is changed to 7 parts by weight for the preparation of Polytetrafluoroethylene particle suspension (A).

Example 5

Photoreceptor 10

Photoreceptor 10 is prepared with the same preparation method as that Photoreceptor 1, except that, when a protective layer is formed, the amount of polytetrafluoroethylene particles is changed to 15 parts by weight for the preparation of Polytetrafluoroethylene particle suspension (A).

Example 6

Photoreceptor 11

Photoreceptor 11 is prepared with the same preparation method as that of Photoreceptor 1, except that, when a protective layer is formed, the thickness of the protective layer is changed to 3.5 μm.

Example 7

Photoreceptor 12

Photoreceptor 12 is prepared with the same preparation method as of Photoreceptor 1, except that, when a protective layer is formed, the thickness of the protective layer is changed to 10 μm.

Example 8

Photoreceptor 13

Photoreceptor 13 is prepared with the same preparation method as that of Photoreceptor 1, except that, when a protective layer is formed, the compound represented by Formula I-8 is changed to the compound represented by Formula I-16.

Example 9

Photoreceptor 14

Photoreceptor 14 is prepared with the same preparation method as that of Photoreceptor 1, except that, when a protective layer is formed, 55 parts by weight of compound represented by Formula I-8, 25 parts by weight of compound represented by Formula I-26, and 15 parts by weight of compound represented by Formula I-16 are used to form Curable-film-forming solution (B).

Evaluation of Photoreceptors

In the cross-sections of the protective layers of the obtained photoreceptors, values of $A_1$, $A_2$, $A_3$, and $A_4$ are obtained according to the above-described method. The results thereof are shown in Table 1.

Using the obtained photoreceptors, an image forming test is performed. Specifically, for the test, a DocuCentre-II C7500 (manufactured by Fuji Xerox Co., Ltd.) is modified so as to print an image at 150 sheets/minute and used. Images having an image density of 5% are formed on A4-sized sheets at 150 sheets/minute in black-and-white mode in a high-temperature and high-humidity environment (28° C., 80% RH).

The cleaning property in the initial stage and the cleaning property after use are evaluated by measuring the difference (ΔD) between the maximum value and the minimum value of reflection density of a half-tone image having a write density of 50% which is printed on the entire surface, regarding a 500th-printed image (initial stage), an image printed when the protective layer is worn away by 1 μm from the average thickness (at the time of being worn away by 1 μm), and an image printed when the protective layer is worn away by 2 μm from the average thickness (at the time of being worn away by 2 μm). The evaluation criteria are as follows and the results are shown in Table 1

G1: less than 0.01

G2: from 0.01 to less than 0.02

G3: from 0.02 to less than 0.03

G4: greater than or equal to 0.03

TABLE 1

| | | Ratio of Surface Area of Fluororesin Particles | | | | | | | Evaluation Result | | |
|---|---|---|---|---|---|---|---|---|---|---|---|
| | | $A_1$ | $A_2$ | $A_3$ | $A_4$ | $A_1/A_4$ | $A_2/A_4$ | $A_3/A_4$ | Cleaning Property in Initial Stage | Cleaning Property at Time of Being Worn Away by 1 μm | Cleaning Property at Time of Being Worn Away by 2 μm |
| Example 1 | Photoreceptor 1 | 0.54 | 2.59 | 4.43 | 5.40 | 0.10 | 0.48 | 0.82 | G2 | G1 | G1 |
| Example 2 | Photoreceptor 2 | 0.27 | 1.35 | 3.29 | 5.40 | 0.05 | 0.25 | 0.61 | G1 | G2 | G2 |
| Example 3 | Photoreceptor 3 | 1.08 | 3.13 | 5.56 | 5.40 | 0.20 | 0.58 | 1.03 | G2 | G2 | G1 |
| Example 4 | Photoreceptor 9 | 0.23 | 1.25 | 3.04 | 3.80 | 0.06 | 0.33 | 0.80 | G1 | G1 | G2 |
| Example 5 | Photoreceptor 10 | 1.46 | 4.70 | 7.29 | 8.10 | 0.18 | 0.58 | 0.90 | G2 | G2 | G1 |
| Example 6 | Photoreceptor 11 | 0.97 | 3.24 | 7.02 | 5.40 | 0.18 | 0.60 | 1.30 | G2 | G2 | G1 |
| Example 7 | Photoreceptor 12 | 0.54 | 2.43 | 5.40 | 5.40 | 0.10 | 0.45 | 1.00 | G2 | G1 | G1 |
| Example 8 | Photoreceptor 13 | 0.65 | 2.97 | 5.13 | 5.40 | 0.12 | 0.55 | 0.95 | G2 | G2 | G1 |
| Example 9 | Photoreceptor 14 | 0.22 | 1.89 | 4.32 | 5.40 | 0.04 | 0.35 | 0.80 | G1 | G1 | G1 |
| Comparative Example 1 | Photoreceptor 4 | 0.05 | 0.92 | 2.05 | 5.40 | 0.01 | 0.17 | 0.38 | G1 | G4 | G3 |
| Comparative Example 2 | Photoreceptor 5 | 3.24 | 4.86 | 5.40 | 5.40 | 0.60 | 0.90 | 1.00 | G3 | G3 | G1 |
| Comparative Example 3 | Photoreceptor 6 | 1.24 | 3.24 | 5.51 | 5.40 | 0.23 | 0.60 | 1.02 | G3 | G2 | G1 |
| Comparative Example 4 | Photoreceptor 7 | 0.81 | 3.35 | 5.40 | 5.40 | 0.15 | 0.62 | 1.00 | G2 | G3 | G1 |
| Comparative Example 5 | Photoreceptor 8 | 0.27 | 1.30 | 3.19 | 5.40 | 0.05 | 0.24 | 0.59 | G1 | G2 | G3 |

It can be seen from the above results that, when the electrophotographic photoreceptors obtained in the above-described Examples are compared to those of the above-described Comparative Examples, a cleaning property in the initial stage and a cleaning property after use are superior; removability for toner remaining on the surface is maintained for a longer period of time; and a high-quality image is formed for a longer period of time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. An electrophotographic photoreceptor comprising:

a substrate;

a photosensitive layer that is provided on the substrate; and a surface layer that is provided on the photosensitive layer, contains fluororesin particles, is a single layer having a thickness of 3 μm or greater, and has a cross-section, taken along a thickness direction thereof, which satisfies Expressions (1), (2), and (3) below:

$$0 \leq A_1 \leq 0.2 \times A_4 \quad \text{Expression (1)}$$

$$0.2 \times A_4 < A_2 \leq 0.6 \times A_4 \quad \text{Expression (2)}$$

$$0.6 \times A_4 < A_3 \quad \text{Expression (3)}$$

wherein, $A_1$ represents the ratio (%) of the area of the fluororesin particles to the total area of a first region in cross-section, in which the first region is located in a distance range of greater than or equal to 0.2 μm and less than 0.5 μm from the outermost surface of the surface layer to the substrate side;

$A_2$ represents the ratio (%) of the area of the fluororesin particles to the total area of a second region in cross-section, in which the second region is located in a distance range of greater than or equal to 0.5 μm and less than 1.5 μm from the outermost surface of the surface layer to the substrate side;

$A_3$ represents the ratio (%) of the area of the fluororesin particles to the total area of a third region in cross-section, in which the third region is located in a distance range of 1.5 μm to (the thickness of the surface layer-0.5 μm) from the outermost surface of the surface layer to the substrate side; and $A_4$ represents the ratio (%) of the area of the fluororesin particles to the total area of the cross-section.

2. The electrophotographic photoreceptor according to claim 1, wherein the surface layer contains a cross-linked component, and the cross-linked component is a reaction product of a cross-linking compound having an alkoxy group and a cross-linking compound having a hydroxyl group.

3. The electrophotographic photoreceptor according to claim 2, wherein the cross-linking compound having an alkoxy group is a compound having two or more alkoxy groups, and the cross-linking compound having a hydroxyl group is a compound having two or more hydroxyl groups.

4. The electrophotographic photoreceptor according to claim 1, wherein the thickness of the surface layer is from 3 μm to 15 μm.

5. The electrophotographic photoreceptor according to claim 1, wherein the thickness of the surface layer is from 6 μm to 10 μm.

6. The electrophotographic photoreceptor according to claim 1, wherein a content of the fluororesin particles is from 1% by weight to 30% by weight.

7. The electrophotographic photoreceptor according to claim 1, wherein an average primary particle size of the fluororesin particles is from 0.05 μm to 1 μm.

8. The electrophotographic photoreceptor according to claim 1, wherein the fluororesin is selected from a group consisting of polytetrafluoroethylene, polychlorotrifluoroethylene, polyhexafluoropropylene, polyvinyl fluoride, polyvinylidene fluoride, and polydichlorodifluoroethylene.

9. The electrophotographic photoreceptor according to claim 1, wherein the surface layer satisfies the following expressions:

$$0 \leq A_1 \leq 0.1 \times A_4 \quad \text{Expression (4)}$$

$$0.3 \times A_4 < A_2 \leq 0.5 \times A_4 \quad \text{Expression (5)}$$

$$0.9 \times A_4 < A_3 \quad \text{Expression (6)}$$

wherein, $A_1$ represents the ratio (%) of the area of the fluororesin particles to the total area of a first region in cross-section, in which the first region is located in a distance range of greater than or equal to 0.2 μm and less than 0.5 μm from the outermost surface of the surface layer to the substrate side;

$A_2$ represents the ratio (%) of the area of the fluororesin particles to the total area of a second region in cross-section, in which the second region is located in a distance range of greater than or equal to 0.5 μm and less than 1.5 μm from the outermost surface of the surface layer to the substrate side;

$A_3$ represents the ratio (%) of the area of the fluororesin particles to the total area of a third region in cross-section, in which the third region is located in a distance range of 1.5 μm to (the thickness of the surface layer-0.5 μm) from the outermost surface of the surface layer to the substrate side; and $A_4$ represents the ratio (%) of the area of the fluororesin particles to the total area of the cross-section.

10. The electrophotographic photoreceptor according to claim 1, wherein the surface layer further contains a copolymer having an alkyl fluoride group.

11. A process cartridge comprising:

an electrophotographic photoreceptor; and at least one unit selected from a charging unit (A) that charges a surface of the electrophotographic photoreceptor; a latent image forming unit (B) that forms an electrostatic latent image on a charged surface of the electrophotographic photoreceptor; a developing unit (C) that develops the electrostatic latent image formed on the surface of the electrophotographic photoreceptor by using a toner to form a toner image; a transfer unit (D) that transfers the toner image, which is formed on the surface of the electrophotographic photoreceptor, onto a recording medium; and a cleaning unit (E) that cleans the electrophotographic photoreceptor, wherein the electrophotographic photoreceptor is the electrophotographic photoreceptor according to claim 1.

12. The process cartridge according to claim 11, wherein a surface layer of the electrophotographic photoreceptor includes a cross-linked component, and the cross-linked component is a reaction product of a cross-linking compound having an alkoxy group and a cross-linking compound having a hydroxyl group.

13. The process cartridge according to claim 11, wherein a surface layer of the electrophotographic photoreceptor satisfies the following expressions:

$$0 \leq A_1 \leq 0.1 \times A_4 \quad \text{Expression (4)}$$

$$0.3 \times A_4 < A_2 \leq 0.5 \times A_4 \quad \text{Expression (5)}$$

$$0.9 \times A_4 < A_3 \quad \text{Expression (6)}$$

wherein, $A_1$ represents the ratio (%) of the area of the fluororesin particles to the total area of a first region in cross-section, in which the first region is located in a distance range of greater than or equal to 0.2 μm and less than 0.5 μm from the outermost surface of the surface layer to the substrate side;

$A_2$ represents the ratio (%) of the area of the fluororesin particles to the total area of a second region in cross-section, in which the second region is located in a distance range of greater than or equal to 0.5 μm and less than 1.5 μm from the outermost surface of the surface layer to the substrate side;

$A_3$ represents the ratio (%) of the area of the fluororesin particles to the total area of a third region in cross-section, in which the third region is located in a distance range of 1.5 μm to (the thickness of the surface layer-0.5 μm) from the outermost surface of the surface layer to the substrate side; and $A_4$ represents the ratio (%) of the area of the fluororesin particles to the total area of the cross-section.

14. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor by using a toner to form a toner image; and a transfer unit that transfers the toner image, which is formed on the surface of the electrophotographic photoreceptor, onto a recording medium, wherein the electrophotographic photoreceptor is the electrophotographic photoreceptor according to claim 1.

15. The image forming apparatus according to claim 14, wherein a surface layer of the electrophotographic photoreceptor contains a cross-linked component, and the cross-linked component is a reaction product of a cross-linking compound having an alkoxy group and a cross-linking compound having a hydroxyl group.

16. The image forming apparatus according to claim 14, wherein a surface layer of the electrophotographic photoreceptor satisfies the following expressions:

$$0 \leq A_1 \leq 0.1 \times A_4 \quad \text{Expression (4)}$$

$$0.3 \times A_4 < A_2 \leq 0.5 \times A_4 \quad \text{Expression (5)}$$

$$0.9 \times A_4 < A_3 \quad \text{Expression (6)}$$

wherein, $A_1$ represents the ratio (%) of the area of the fluororesin particles to the total area of a first region in cross-section, in which the first region is located in a distance range of greater than or equal to 0.2 μm and less than 0.5 μm from the outermost surface of the surface layer to the substrate side;

$A_2$ represents the ratio (%) of the area of the fluororesin particles to the total area of a second region in cross-section, in which the second region is located in a distance range of greater than or equal to 0.5 μm and less than 1.5 μm from the outermost surface of the surface layer to the substrate side;

$A_3$ represents the ratio (%) of the area of the fluororesin particles to the total area of a third region in cross-section, in which the third region is located in a distance range of 1.5 μm to (the thickness of the surface layer-0.5 μm) from the outermost surface of the surface layer to the substrate side; and $A_4$ represents the ratio (%) of the area of the fluororesin particles to the total area of the cross-section.

* * * * *